US009494153B2

(12) United States Patent
Watanabe et al.

(10) Patent No.: US 9,494,153 B2
(45) Date of Patent: Nov. 15, 2016

(54) VARIABLE DISPLACEMENT OIL PUMP

(71) Applicant: HITACHI AUTOMOTIVE SYSTEMS, LTD., Hitachinaka-shi, Ibaraki (JP)

(72) Inventors: Yasushi Watanabe, Aiko-gun (JP); Hideaki Ohnishi, Atsugi (JP); Koji Saga, Ebina (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 14/073,357

(22) Filed: Nov. 6, 2013

(65) Prior Publication Data

US 2014/0219847 A1 Aug. 7, 2014

(30) Foreign Application Priority Data

Nov. 27, 2012 (JP) ..... 2012-258827

(51) Int. Cl.
*F04C 14/22* (2006.01)
*F04C 2/344* (2006.01)

(52) U.S. Cl.
CPC ..... *F04C 14/226* (2013.01); *F04C 2/3442* (2013.01); *F04C 2210/206* (2013.01); *F04C 2270/185* (2013.01)

(58) Field of Classification Search
CPC ..... F04C 2/3442; F04C 2210/206; F04C 2270/185; F04C 14/226; F04C 29/00; F04C 2270/18; F01C 21/0836
USPC ..... 417/220; 418/20–27, 30, 138, 259, 260, 418/266–268
See application file for complete search history.

(56) References Cited

U.S. PATENT DOCUMENTS 5,518,380 A 5/1996 Fujii et al.
6,530,752 B2 * 3/2003 Oba ..... F04C 14/226 417/220

(Continued)

FOREIGN PATENT DOCUMENTS

EP 2 253 847 A1 11/2010
JP 59-70891 A 4/1984

(Continued)

OTHER PUBLICATIONS

U.S. Appl. No. 14/073,347, filed Nov. 6, 2013, Hitachi Automotive Systems, Ltd.

(Continued)

*Primary Examiner* — Devon Kramer
*Assistant Examiner* — Connor Tremarche
(74) *Attorney, Agent, or Firm* — Foley & Lardner LLP

(57) ABSTRACT

A variable displacement oil pump includes: a switching mechanism arranged to switch a state in which the hydraulic fluid is introduced to the second control hydraulic chamber through a connection passage, and a state in which the hydraulic fluid is discharged from the second control hydraulic chamber through the connection passage; and a control mechanism arranged to be actuated before the eccentric amount of the cam ring becomes minimum, and arranged to vary an opening area of the connection passage as the discharge pressure is increased, and to vary an opening area of a discharge passage arranged to discharge the hydraulic fluid within the second control hydraulic chamber, in a direction opposite to a direction of a variation of the opening area of the introduction passage.

11 Claims, 11 Drawing Sheets

(56) References Cited

U.S. PATENT DOCUMENTS

| | | | | |
|---|---|---|---|---|
| 6,672,844 | B2 | 1/2004 | Fukanuma et al. | |
| 8,684,702 | B2 | 4/2014 | Watanabe et al. | |
| 9,109,596 | B2 * | 8/2015 | Ohnishi | F04C 2/344 |
| 2008/0308062 | A1 | 12/2008 | Morita et al. | |
| 2009/0022612 | A1 | 1/2009 | Williamson et al. | |
| 2010/0028171 | A1 | 2/2010 | Shulver et al. | |
| 2010/0205952 | A1 | 8/2010 | Yamamuro et al. | |
| 2010/0329912 | A1 | 12/2010 | Williamson et al. | |
| 2011/0085921 | A1 | 4/2011 | Kato et al. | |
| 2011/0123379 | A1 | 5/2011 | Saga et al. | |
| 2011/0194967 | A1 * | 8/2011 | Watanabe | F04C 14/226 418/138 |
| 2012/0213655 | A1 | 8/2012 | Ohnishi et al. | |
| 2013/0089446 | A1 | 4/2013 | Williamson et al. | |
| 2013/0164163 | A1 | 6/2013 | Ohnishi et al. | |
| 2013/0195705 | A1 | 8/2013 | Williamson et al. | |
| 2014/0072456 | A1 | 3/2014 | Watanabe et al. | |
| 2014/0072458 | A1 | 3/2014 | Watanabe et al. | |
| 2014/0119969 | A1 | 5/2014 | Iijima | |
| 2014/0147322 | A1 * | 5/2014 | Saga | F04C 2/344 418/24 |
| 2015/0020759 | A1 | 1/2015 | Watanabe et al. | |
| 2015/0218983 | A1 | 8/2015 | Watanabe et al. | |

FOREIGN PATENT DOCUMENTS

| | | | |
|---|---|---|---|
| JP | 2004-218529 | A | 8/2004 |
| JP | 2008-524500 | | 7/2008 |
| JP | 2011-080430 | A | 4/2011 |
| WO | WO-2012/113437 | A1 | 8/2012 |

OTHER PUBLICATIONS

Watanabe: US Notice of Allowance on U.S. Appl. No. 13/852,636 dated Mar. 24, 2016.

Watanabe: US Office Action on U.S. Appl. No. 13/974,686 dated Mar. 24, 2016.

Saga: US Office Action on U.S. Appl. No. 14/073,347 dated Apr. 8, 2016.

Saga, Non-Final Office Action dated Aug. 14, 2015 issued in corresponding U.S. Appl. No. 14/073,347.

Watanabe et al., Non-Final Office Action dated Aug. 28, 2015 issued in corresponding U.S. Appl. No. 13/852,636.

Saga: US Notice of Allowance on U.S. Appl. No. 14/073,347 dated Jul. 21, 2016.

* cited by examiner

VARIABLE DISPLACEMENT OIL PUMP

BACKGROUND OF THE INVENTION

This invention relates to a variable displacement oil pump for an internal combustion engine for a vehicle.

In recent years, there is an demand that an oil discharged from an oil pump has two stepped (stepwise) characteristics which are a low pressure characteristic in a first engine speed region, and a high pressure characteristic in a second engine speed region, for using the oil discharged from the oil pump, in, for example, devices such as sliding portions of an engine, a variable valve actuating apparatus arranged to control operation characteristics of engine valves, which have different desired discharge pressures.

A Japanese Patent Application Publication No. 2008-524500 (corresponding to U.S. Patent Application Publication No. 2009/022612 A1, U.S. Patent Application Publication No. 2010/329912 A1, U.S. Patent Application Publication No. 2013/098446 A1, and U.S. Patent Application Publication No. 2013/195705 A1) discloses a variable displacement pump devised to satisfy the above-described demands. The above-described variable displacement pump includes a cam ring whose an eccentric amount with respect to a rotor is varied by moving against a spring urging force of a spring member; and two pressure receiving chambers which confront each other, and which are formed on an outer circumference surface of the cam ring. In this variable displacement pump, the pump discharge pressure is selectively acted to these pressure receiving chambers, so that the cam ring is actuated in two stepped (stepwise) manner.

SUMMARY OF THE INVENTION

However, in the above-described variable displacement pump, the cam ring is needed to be urged by the spring member having a relatively large spring constant. The moving ability (mobility) of the cam ring in a direction toward the small eccentric amount is decreased with respect to the increase of the discharge pressure. The discharge pressure is largely increased in accordance with the increase of the pump rotational speed even when the pressure is held to the first discharge pressure or the second discharge pressure. Accordingly, the discharge pressure is deviated from the desired discharge characteristic.

It is, therefore, an object of the present invention to provide a variable displacement oil pump which is devised to solve the above mentioned problems, and to suppress an excessive increase of a discharge pressure even when a pump rotational speed is increased when a desired discharge pressure is needed to be held.

According to one aspect of the present invention, a variable displacement oil pump comprises: a rotor rotationally driven; a plurality of vanes provided in an outer circumference portion of the rotor to be projectable from and retractable into the rotor; a cam ring which receives the rotor and the vanes therein to form a plurality of pump chambers, and which is moved so as to vary an eccentric amount of a center of an inner circumference surface of the cam ring with respect to a center of a rotation of the rotor; a suction portion opened in the pump chambers whose volumes are increased when the cam ring is eccentrically moved in a first direction with respect to the center of the rotation of the rotor; a discharge portion opened in the pump chambers whose volumes are decreased when the cam ring is eccentrically moved in a second direction with respect to the center of the rotation of the rotor; an urging member arranged to urge the cam ring in the first direction in which the eccentric amount of the cam ring is increased with respect to the center of the rotation of the rotor; a first control hydraulic chamber which is arranged to receive a discharge pressure from the discharge portion through an introduction passage, and thereby to apply, to the cam ring, a force to eccentrically move the cam ring in the second direction in which the eccentric amount of the cam ring is decreased against an urging force of the urging member; a second control hydraulic chamber which is arranged to receive the hydraulic fluid, and thereby to apply, to the cam ring, to a force to move the cam ring in the first direction by cooperating with the urging force of the urging member; a switching mechanism arranged to switch a state in which the hydraulic fluid is introduced to the second control hydraulic chamber through a connection passage connecting the discharge portion and the second control hydraulic chamber, and a state in which the hydraulic fluid is discharged from the second control hydraulic chamber through the connection passage; and a control mechanism which is arranged to be actuated before the eccentric amount of the cam ring becomes minimum, and which is arranged to vary an opening area of the connection passage as the discharge pressure is increased, and to vary an opening area of a discharge passage arranged to discharge the hydraulic fluid within the second control hydraulic chamber, in a direction opposite to a direction of a variation of the opening area of the introduction passage.

According to another aspect of the invention, a variable displacement oil pump comprises: a rotor rotationally driven; a plurality of vanes provided in an outer circumference portion of the rotor to be projectable from and retractable into the rotor; a cam ring which receives the rotor and the vanes therein to form a plurality of pump chambers, and which is moved so as to vary an eccentric amount of a center of an inner circumference surface of the cam ring with respect to a center of a rotation of the rotor; a suction portion opened in the pump chambers whose volumes are increased when the cam ring is eccentrically moved in a first direction with respect to the center of the rotation of the rotor; a discharge portion opened in the pump chambers whose volumes are decreased when the cam ring is eccentrically moved in a second direction with respect to the center of the rotation of the rotor; an urging member arranged to urge the cam ring in the first direction in which the eccentric amount of the cam ring is increased with respect to the center of the rotation of the rotor; a first control hydraulic chamber which is arranged to receive a discharge pressure from the discharge portion, and thereby to apply, to the cam ring, a force to eccentrically move the cam ring in the second direction in which the eccentric amount of the cam ring is decreased against an urging force of the urging member; a second control hydraulic chamber which is arranged to receive the hydraulic fluid, and thereby to apply, to the cam ring, to a force to move the cam ring in the first direction by cooperating with the urging force of the urging member; a switching mechanism arranged to switch a state in which the hydraulic fluid is introduced to the second control hydraulic chamber through a connection passage connecting the discharge portion and the second control hydraulic chamber, and a state in which the hydraulic fluid is discharged from the second control hydraulic chamber through the connection passage; and a control mechanism including; a valve body including an introduction port to which the discharge pressure is introduced, a first control port connected to the first control hydraulic chamber, a second control port connected to the second control hydraulic chamber through the connection passage, a connection port connected to the connection passage on the switching mechanism's side, and a drain port arranged to be connected to the second control port, a spool valve slidably received within the valve body, and arranged to control connection states of the introduction port, the first control port, the second control port, the connection port, and the drain port, and a control spring arranged to urge the spool valve in one direction by the urging force smaller than the urging force of the urging member, the control mechanism being arranged to be brought to a first state in which the spool valve closes the introduction port, the first control port and the drain port are connected with each other, and the second control port and the connection port are connected with each other, at an initial position at which the spool valve is maximally moved in the one direction by being urged by the control spring, and to be brought to a second state in which the introduction port and the first control port are connected with each other, and the second control port and the drain port are connected with each other when the hydraulic pressure within the introduction port becomes high by the increase of the discharge pressure and the spool valve is moved in the other direction against the urging force of the control spring, and the control mechanism being arranged to vary an opening area of a flow passage from the second control port to the drain port, in a direction opposite to a variation of an opening area of the first control port, when the spool valve is moved in the other direction against the spring force of the control spring.

According to still another aspect of the invention, a variable displacement oil pump comprises: a pump constituting section arranged to vary volumes of a plurality of hydraulic fluid chambers by being rotationally driven, and thereby to discharge an oil sucked from a suction portion, from a discharge portion; a variable mechanism arranged to vary a variation amount of the volumes of the hydraulic fluid chambers opened to the discharge portion, by a movement of a movable member; an urging member arranged to urge the movable member in a state to apply, to the movable member, a spring force in a direction in which variation amounts of volumes of the hydraulic fluid chambers opened to the discharge portion are increased; a first control hydraulic chamber which is arranged to receive the discharge pressure from the discharge portion, and thereby to apply, to the movable mechanism, a force in a direction opposite to the direction of the urging force of the urging member; a second control hydraulic chamber which is arranged to receive the hydraulic fluid, and thereby to apply, to the movable mechanism, a force in a direction identical to the direction of the urging force of the urging member; a switching mechanism arranged to switch a state in which the hydraulic fluid whose pressure is smaller than the discharge pressure is introduced from the discharge portion to the second control hydraulic chamber, and a state in which the hydraulic fluid within second control hydraulic chamber is discharged; and a control mechanism which is actuated before the variation amounts of the volumes becomes minimum by the variable mechanism, and which includes a first throttling portion which is arranged to increase a throttling area as the discharge pressure becomes larger, and a second throttling portion which is arranged to decrease a throttling area as the discharge pressure becomes larger, the control mechanism being arranged to decrease the hydraulic fluid supplied from the switching mechanism to the second control hydraulic chamber, by one of the first throttling portion and the second throttling portion, and to decrease the hydraulic fluid discharged from the second control hydraulic chamber to a low pressure portion, by the other of the first throttling portion and the second throttling portion.

According to still another aspect of the invention, a variable displacement oil pump comprises: a rotor rotationally driven; a plurality of vanes provided in an outer circumference portion of the rotor to be projectable from and retractable into the rotor; a cam ring which receives the rotor and the vanes therein to form a plurality of pump chambers, and which is moved so as to vary an eccentric amount of a center of an inner circumference surface of the cam ring with respect to a center of a rotation of the rotor; a suction portion opened in the pump chambers whose volumes are increased when the cam ring is eccentrically moved in a first direction with respect to the center of the rotation of the rotor; a discharge portion opened in the pump chambers whose volumes are decreased when the cam ring is eccentrically moved in a second direction with respect to the center of the rotation of the rotor; an urging member arranged to urge the cam ring in the first direction in which the eccentric amount of the cam ring is increased with respect to the center of the rotation of the rotor; a first control hydraulic chamber which is arranged to receive a discharge pressure from the discharge portion through an introduction passage, and thereby to apply, to the cam ring, a force to eccentrically move the cam ring in the second direction in which the eccentric amount of the cam ring is decreased against an urging force of the urging member; a second control hydraulic chamber which is arranged to receive the hydraulic fluid, and thereby to apply, to the cam ring, to a force to move the cam ring in the first direction by cooperating with the urging force of the urging member; a switching mechanism arranged to switch a state in which the hydraulic fluid is introduced to the second control hydraulic chamber through a connection passage connecting the discharge portion and the second control hydraulic chamber, and a state in which the hydraulic fluid is discharged from the second control hydraulic chamber through the connection passage; and a control mechanism arranged to supply the discharge pressure to the first control hydraulic chamber or shut off the supply of the discharge pressure to the first control hydraulic chamber, in accordance with the discharge pressure of the discharge portion, and to supply a hydraulic pressure through the connection passage to the second control hydraulic chamber or discharge the hydraulic pressure through the connection passage from the second control hydraulic chamber, in accordance with the discharge pressure of the discharge portion, the control mechanism being arranged to supply the discharge pressure to the first control hydraulic chamber and to discharge the hydraulic fluid within the second control hydraulic chamber when the discharge pressure of the discharge portion is greater than a desired discharge pressure.

DETAILED DESCRIPTION OF THE INVENTION

Hereinafter, a variable displacement oil pump according to one embodiment of the present invention is illustrated with reference to the drawings. Besides, the below-described embodiment shows that the present invention is applied to a variable displacement oil pump which is used as a driving source of a variable valve actuating mechanism arranged to vary valve timings of engine valves of an internal combustion engine of a vehicle, and which is arranged to supply a lubricating oil to sliding portions of the engine, in particular, sliding portions between a piston and a cylinder bore by an oil jet, and to supply the lubricating oil to bearings of a crank shaft.

Figure 1:
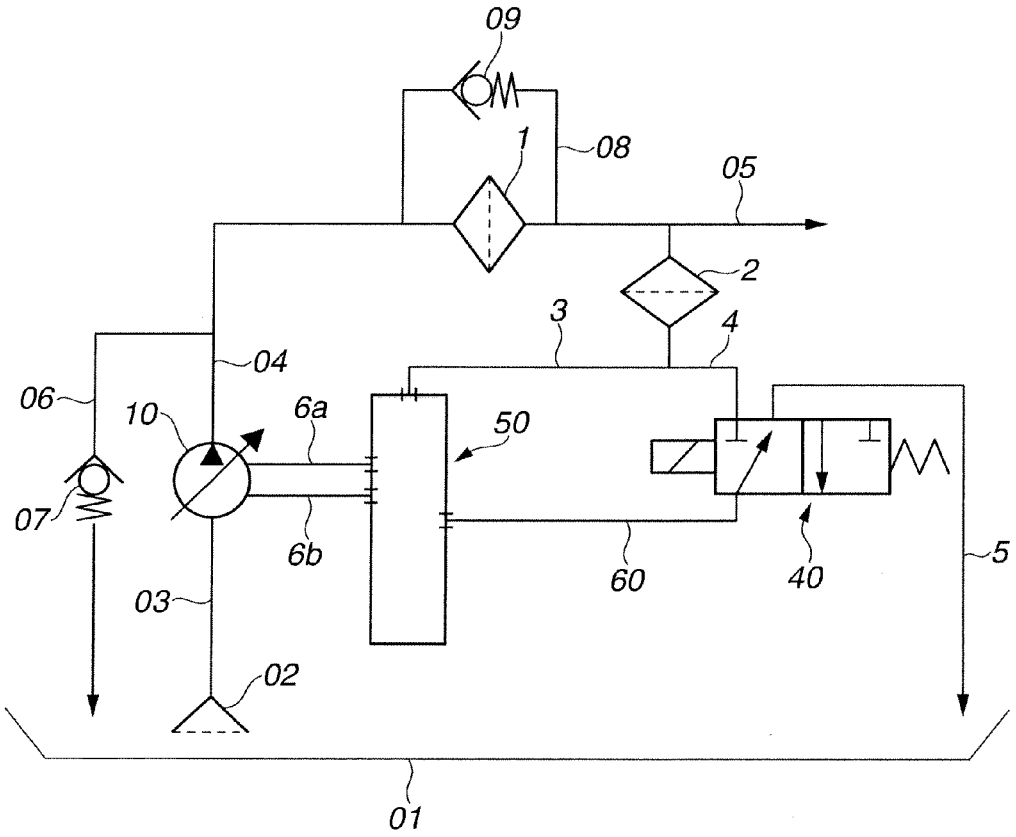
FIG. 1 is a schematic view showing a hydraulic circuit of an oil supply system using a variable displacement oil pump according to one embodiment of the present invention.

FIG. 1 shows a hydraulic circuit using the variable displacement oil pump according to this embodiment of the present invention. A variable displacement oil pump 10 is arranged to be rotated by a rotational driving force transmitted from a crank shaft of the internal combustion engine, and thereby to suck an oil stored in an oil pan 01, through a strainer 02 from a suction passage 03, and to discharge the sucked oil from a discharge passage 04 which is a discharge portion to a main oil gallery 05 of the engine.

In a relief passage 06 bifurcated from discharge passage 04, there is provided a relief valve 07 which is a check ball type, and which is arranged to return the oil to oil pan 01 when the pump discharge pressure is excessively high.

Main oil gallery 05 is arranged to supply the oil to an oil jet arranged to inject a coolant oil to sliding portions of the engine such as a piston, and the valve timing control device, and bearings of the crank shaft. On the upstream side of discharge passage 04, there is provided a first oil filter 1 arranged to collect foreign matter in the flowing oil. Moreover, there is provided a bypass passage 08 which bypasses first oil filter 1 of main oil gallery 05. Furthermore, on bypass passage 08, there is provided a bypass valve 09 which is a check ball type, and which is arranged to open to flow the oil on the downstream side through bypass passage 08 when first oil filter 1 is clogged and the oil is difficult to flow.

Moreover, there is provided a first branch passage 3 which is located on the downstream side of first oil filter 1 in main oil gallery 05, and which is bifurcated from main oil gallery 05. A downstream side of this first branch passage 3 is connected through a pilot valve 50 which is a control mechanism, and through a first supply and discharge passage 6*a* to a first control hydraulic chamber 31 (described later) of oil pump 10. Furthermore, there is provided a second branch passage 4 which is bifurcated from first branch passage 3. On the downstream side of second branch passage 4, there is provided an electromagnetic switching valve 40 which is a switching mechanism. This electromagnetic switching valve 40 is connected through an intermediate passage 60 to pilot valve 50. This pilot valve 50 is connected through a second supply and discharge passage 6*b* to a second control hydraulic chamber 32 (described later) of oil pump 10.

Electromagnetic switching valve 40 is controlled by a control unit (not shown) to be switched between an ON state (energization) and an OFF state (deenergization). Electromagnetic switching valve 40 is arranged to connect second branch passage 4 and intermediate passage 60, or to intermediate passage 60 and drain passage 5. Concrete structures and so on are illustrated later.

Figure 5:
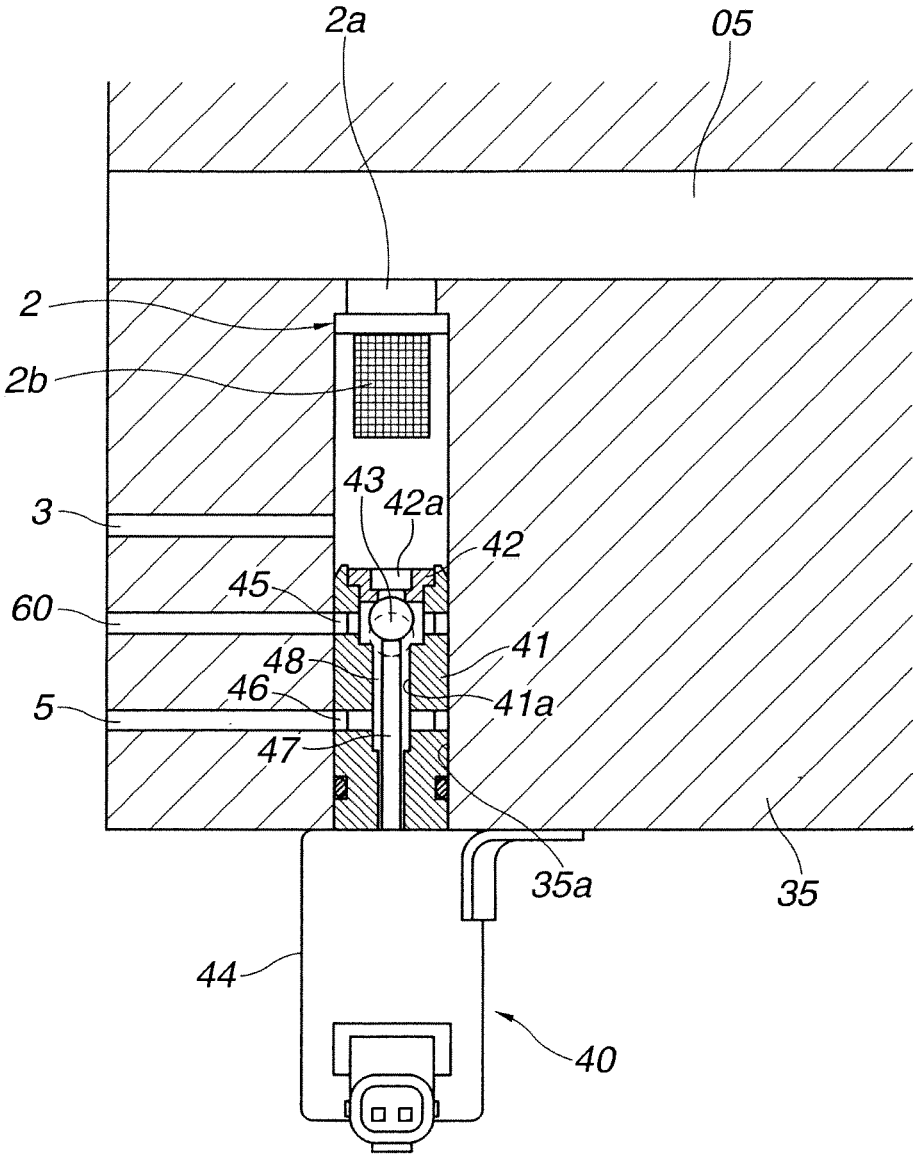
FIG. 5 is a sectional view showing a mounting state an electromagnetic switching valve and a second oil filter in the variable displacement oil pump of FIG. 2.

Moreover, there is provided a second oil filter 2 located in first branch passage 3 near a branch portion between first branch passage 3 and main oil gallery 05. As shown in FIG. 5, this second oil filter 2 includes a substantially cylindrical main body 2*a* which is fixed, by press fit, in the branch portion of first branch passage 3 between large diameter branch passage 3 and main oil gallery 05; and a mesh portion 2*b* which is made from a metal, which has a bottomed cylindrical shape, and which is connected to one end portion of main body 2*a*. Oil filter 2 is arranged to prevent contamination mixed in the oil from flowing into, in particular, electromagnetic switching valve 40.

These first and second oil filters 1 and 2 are constituted, for example, by a filter and a mesh portion made from the metal. In a case where the filter and the mesh portion are clogged, it is possible to change the filter, or to change by exchangeable cartridge type. A diameter of net (reticulation) of mesh portion 2*b* of second oil filter 2 is larger than a diameter of net (reticulation) of a mesh portion of first oil filter 1.

Figure 2:
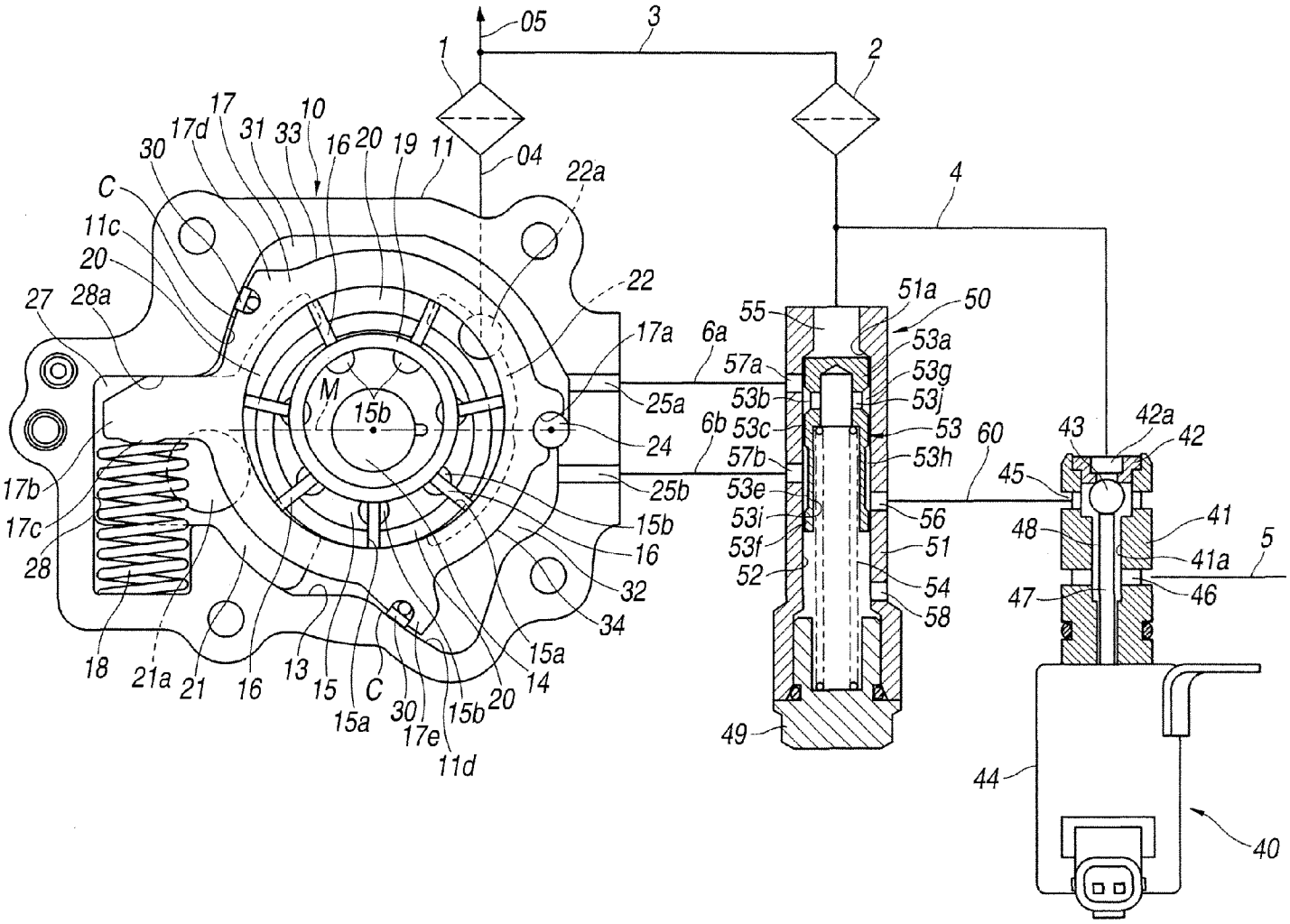
FIG. 2 is an overall schematic view which shows a variable displacement oil pump according to the one embodiment of the present invention, and which shows a state in which an eccentric amount of a cam ring of the oil pump is in a maximum state.
Figure 3:
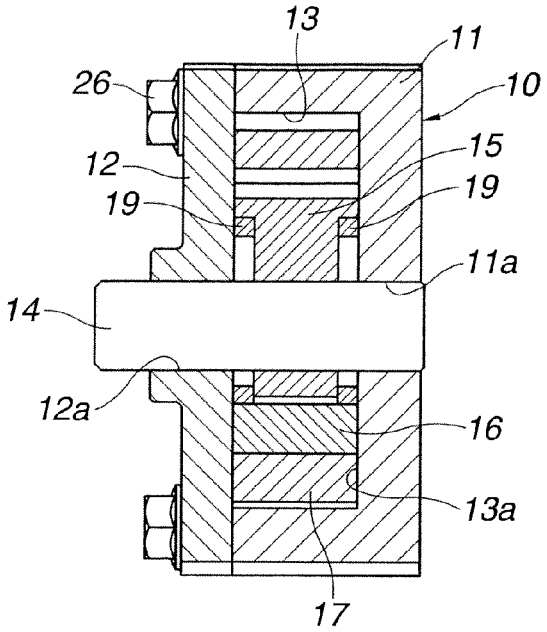
FIG. 3 is a longitudinal sectional view showing the oil pump of FIG. 2.
Figure 4:
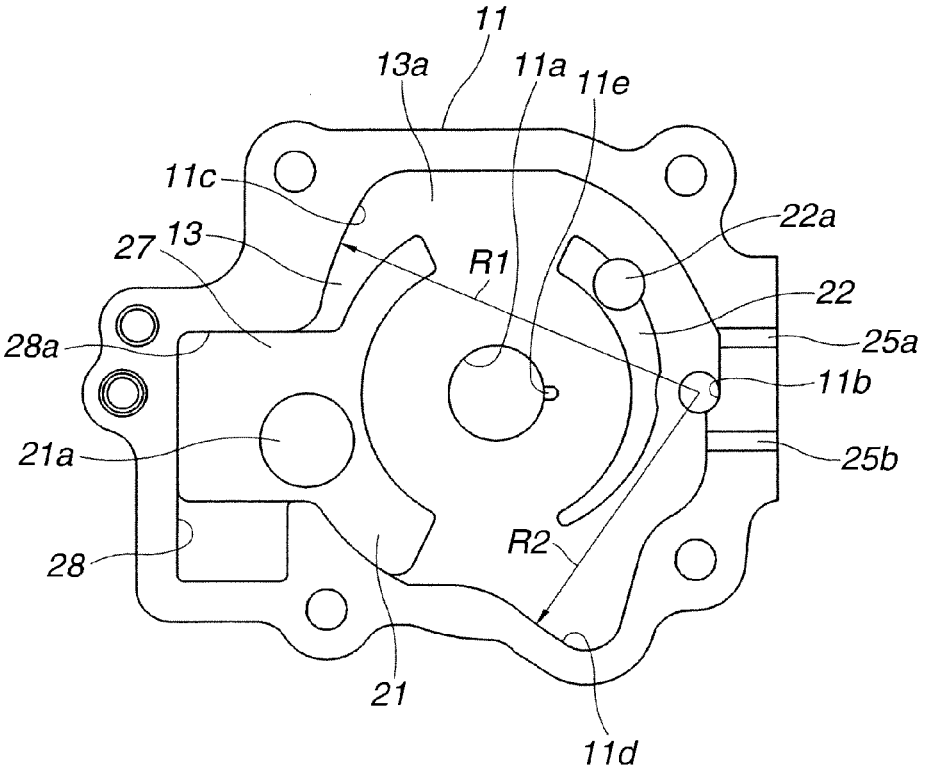
FIG. 4 is a front view showing a pump body of the variable displacement oil pump of FIG. 2

Oil pump 10 is provided to a front end portion and so on of a cylinder block 35 of the internal combustion engine. As shown in FIG. 2 to FIG. 4, oil pump 10 includes a housing including a pump body 11 which has a substantially U-shaped cross section, and which includes a pump receiving chamber 13 that has one end opening, and that is a cylindrical hollow space formed inside pump body 11, and a cover member 12 closing the one end opening of pump body 11; a drive shaft 14 which is rotationally supported on the housing, which penetrates through a substantially central portion of pump receiving chamber 13, and which is rotationally driven by the crank shaft of the engine; a pump constituting (forming) section which includes a rotor 15 that is rotationally received within pump receiving chamber 13, and that includes a central portion connected to drive shaft 14, and vanes 16 which are received in a plurality of slits 15*a* formed by cutting in an outer circumference portion of rotor 15 in the radial directions to be projectable from and retractable into rotor 15; a cam ring 17 which is disposed radially outside the pump constituting section to be moved to be eccentric with respect to a center of the rotation of rotor 15, and which defines pump chambers 20 which are a plurality of hydraulic fluid chambers, with rotor 15 and adjacent two of vanes 16 and 16; a spring 18 which is an urging member (control spring) arranged to constantly urge cam ring 17 in a direction in which an eccentric amount of cam ring 17 with respect to the center of the rotation of rotor 15 is increased; and a pair of ring members 19 and 19 which are slidably disposed on the both side portions of rotor 15 on the inner circumference side, and which have diameters smaller than the diameter of rotor 15.

Pump body 11 is integrally formed from aluminum alloy. As shown in FIG. 3 and FIG. 4, pump body 11 includes a bearing hole 11*a* which is formed at a substantially central position of bottom surface 13*a* of pump receiving chamber 13, which penetrates through pump body 11, and which rotationally supports one end portion of drive shaft 14. Moreover, as shown in FIG. 4, pump body 11 includes a support hole 11*b* which is formed by cutting at a predetermined position on an inner circumference wall of pump receiving chamber 13 that is an inner side surface of pump body 11, and in which a pivot pin 24 swingably supporting cam ring 17 is inserted and fixed. Moreover, pump body 11 includes a holding groove 11*e* which is formed on the inner circumference surface of bearing hole 11*a*, and which is arranged to hold the oil to lubricate drive shaft 14.

Moreover, pump housing 11 includes first and second seal sliding surfaces 11*c* and 11*d* which are formed on the inner circumference wall of pump receiving chamber 13, which are located on both sides of a line M (hereinafter, referred to as a cam ring reference line) connecting a center of bearing hole 11*a* and a center of support hole 11*b*, and on which seal members 30 and 30 disposed on the outer circumference portion of cam ring 17 are slidably abutted. As shown in FIG. 4, these seal sliding surfaces 11*c* and 11*d* have arc surface shapes which are formed around a center of support hole 11*b* by predetermined radii R1 and R2. These seal sliding surfaces 11*c* and 11*d* have circumferential lengths set so that seal members 30 and 30 are constantly slidably abutted on seal sliding surfaces 11*c* and 11*d* in a range of the eccentric swinging movement of cam ring 17. With this, when cam ring 17 is swung to be eccentric, cam ring 17 is guided to be slid along seal sliding surfaces 11*c* and 11*d*. Accordingly, it is possible to obtain the smooth movement (the eccentric swing movement) of cam ring 17.

As shown in FIG. 2 and FIG. 4, pump body 11 includes a suction port 21 which is a suction portion, which has a substantially arc recessed shape, which is formed in bottom surface 13*a* of pump receiving chamber 13, which is formed radially outside bearing hole 11*a*, and which is opened in a region (suction region) in which volumes of pump chambers 20 are increased in accordance with the pump function of the pump constituting section; and a discharge port 22 which is a discharge portion, which has a substantially arc recessed shape, which is formed in bottom surface 13*a* of pump receiving chamber 13, which is formed radially outside bearing hole 11*a*, and which is opened in a region (discharge region) in which volumes of pump chambers 20 are decreased in accordance with the pump function of the pump constituting section. Suction port 21 and discharge port 22 are disposed to substantially confront each other to sandwich bearing hole 11*a*.

Suction port 21 includes a suction hole 21*a* which extends from a substantially central position of suction port 21 toward a spring receiving chamber 28 (described later)'s side, which penetrates through the bottom wall of pump body 11, and which is opened to the outside. With this, the lubricating oil stored in oil pan 01 of the engine is sucked through suction hole 21*a* and suction port 21 into pump chambers 20 in the suction region based on the negative pressure generated in accordance with the pump function of the pump constituting section.

Suction hole 21*a* is formed to confront the outer circumference region of (a portion radially outside) cam ring 17 on the pump suction side. Suction hole 21*a* is arranged to introduce the suction pressure to the outer circumference region on the pump suction side of cam ring 17. With this, the outer circumference region of cam ring 17 on the pump suction side which is adjacent to pump chambers 20 in the suction region becomes a low pressure portion which has the suction pressure or the atmosphere pressure. Accordingly, the leakage of the lubricating oil from pump chambers 20 in the suction region to the outer circumference region of cam ring 17 on the pump suction side is suppressed.

Discharge port 22 includes a discharge hole 22*a* which is one discharge portion, which penetrates through the bottom wall of pump body 11, which is formed at an upper position in FIG. 4, and which is connected through discharge passage 04 to main oil gallery 05.

By this structure, the oil which is pressurized by the pump function of the pump constituting section, and which is discharged from pump chambers 20 in the discharge region is supplied through discharge port 22 and discharge hole 22*a* to main oil gallery 05, and supplied to the sliding portions of the engine, the valve timing control apparatus and so on.

As shown in FIG. 3, cover member 12 has a substantially plate shape. Cover member 12 includes a cylindrical portion which is formed on an outer side portion of cover member 12 at a position corresponding to bearing hole 11*a* of pump body 11, and a bearing hole 12*a* which is formed on an inner circumference surface of this cylindrical portion, which penetrates through cover member 12, and which rotationally supports the other end side of drive shaft 14. This cover member 12 is mounted on the opening end surface of pump body 11 by a plurality of bolts 26.

Besides, cover member 12 includes a substantially flat inner side surface. Suction port 21 and discharge port 22 may be formed on this inner side surface of cover member 12, like the bottom surface of pump body 11.

Drive shaft 14 is arranged to rotate rotor 15 in the clockwise direction of FIG. 2 by the rotational force transmitted from the crank shaft.

As shown in FIG. 2, rotor 15 includes seven slits 15*a* which are formed by cutting to extend from the radially inner portion (the center side) toward the radially outer side; and back pressure chambers 15*b* which have substantially circular cross sections, each of which is formed at the radially inner base end portion of one of slits 15*a*, and which receive the discharge hydraulic fluid discharged to discharge port 22. With this, vanes 16 are arranged to be pushed in the radially outer direction by the hydraulic pressures of back pressure chambers 15*b* and the centrifugal force of ring members 19 and 19 generated in accordance with the rotation of rotor 15.

Each of vanes 16 includes a tip end surface which is slidably abutted on the inner circumference surface of cam ring 17, and an inner end surface of the base end portion which is slidably abutted on the outer circumference surfaces of ring members 19 and 19. With this, when the engine speed is low and the centrifugal force and the hydraulic pressures of back pressure chambers 15*b* are small, pump chambers 20 are liquid-tightly separated by the outer circumference surface of rotor 15, the inner side surfaces of adjacent two of vanes 16 and 16, the inner circumference surface of cam ring 17, and bottom surface 13*a* of pump receiving chamber 13 of pump body 11 which is a side wall, and the inner side surface of cover member 12 which is the side wall.

Cam ring 17 is integrally formed into an annular shape from sintered metal. Cam ring 17 includes a pivot portion 17*a* which has a substantially arc recessed shape, which is formed at a predetermined position of the outer circumference portion of cam ring 17, which protrudes along the axial direction, and in which pivot pin 24 is mounted to serve as an eccentric swing support point (fulcrum) about which cam ring 17 is pivoted; and an arm portion 17*b* which is formed at a position opposite to pivot portion 17*a* with respect to the center of cam ring 17, which protrudes along the axial direction, and which is linked with spring 18.

Pump body 11 includes a spring receiving chamber 28 which is connected to pump receiving chamber 13 through a connection portion 27 formed at a position opposite to support hole 11*b*. Spring 18 is received within this spring receiving chamber 28.

This spring 18 is elastically held between a bottom surface of spring receiving chamber 28 and a lower surface of a tip end portion of arm portion 17*b* which extends into spring receiving chamber 28 through connection portion 27, so as to have a predetermined set load W. Arm portion 17*b* includes a support protrusion 17*c* which is formed on the lower surface of the tip end portion of arm portion 17*b* to protrude, which has a substantially arc shape, and which is engaged with the inner circumference side of spring 18. One end portion of spring 18 is supported by support protrusion 17*c*.

Accordingly, spring 18 constantly urge cam ring 17 through arm portion 17*b* by the elastic force based on spring load W, in a direction in which the eccentric amount of cam ring 17 is increased (in the clockwise direction in FIG. 2). With this, in the nonactuation state of cam ring 17 shown in FIG. 2, the upper surface of arm portion 17 is pressed on a stopper surface 28*a* formed on a lower surface of the upper wall of spring receiving chamber 28, by the spring force of spring 18, so that cam ring 17 is held at a position at which the eccentric amount of cam ring 17 with respect to the center of the rotation of rotor 15 becomes maximum.

In this way, cam ring 17 includes arm portion 17*b* which extends on the side opposite to pivot portion 17*a*, and the tip end portion of arm portion 17*b* is urged by spring 18. Accordingly, it is possible to generate the maximum torque to cam ring 17. Consequently, it is possible to decrease the size of spring 18, and thereby to decrease the size of the pump.

Moreover, cam ring 17 includes a pair of first and second seal constituting section 17*d* and 17*e* which have substantially triangular cross sections, which are formed in the outer circumference portions of cam ring 17 to protrude, which confront first and second sliding surfaces 11*c* and 11*d*, and which include first and second seal surfaces; and first and second seal holding grooves which are formed by cutting on the seal surfaces of first and second seal constituting sections 17*d* and 17*e*, and which extend in the axial direction. The pair of seal members 30 and 30 are received and held, respectively, in the first and second seal holding grooves of the seal surfaces of first and second seal constituting sections 17*d* and 17*e*. The pair of seal members 30 and 30 are slidably abutted, respectively, on seal sliding surfaces 11*c* and 11*d* at the eccentric swing movement of cam ring 17.

In this case, the first and second seal surfaces are formed around the center of pivot portion 17*a* by predetermined radii slightly smaller than radii R1 and R2 of the corresponding first and second seal sliding surfaces 11*c* and 11*d*. Accordingly, there are formed minute clearances C between the seal surfaces and first and second seal sliding surfaces 11*c* and 11*d*.

Seal members 30 and 30 are formed from, for example, fluorine-based resin having a low frictional characteristic. Seal members 30 and 30 have linear elongated shapes extending in the axial direction of cam ring 17. Seal members 30 and 30 are arranged to be pushed on first and second seal sliding surfaces 11*c* and 11*d* by elastic forces of elastic members which are made from rubber, and which are disposed on the bottom portion of the seal holding grooves. With this, the good liquid-tightness of control hydraulic chambers 31 and 32 are constantly ensured.

Moreover, as shown in FIG. 2, there are provided first control hydraulic chamber 31 and second control hydraulic chamber 32 which are formed radially outside cam ring 17 on the pivot portion 17*a*'s side which is the pump discharge side, between the outer circumference surface of cam ring 17 and the inner side surface of pump body 11, which are positioned on the both sides of pivot portion 17*a*, and which are separated by the outer circumference surface and pivot portion 17*a* of cam ring 17, seal members 30 and 30, and the inner side surface of pump body 11.

Figure 7:
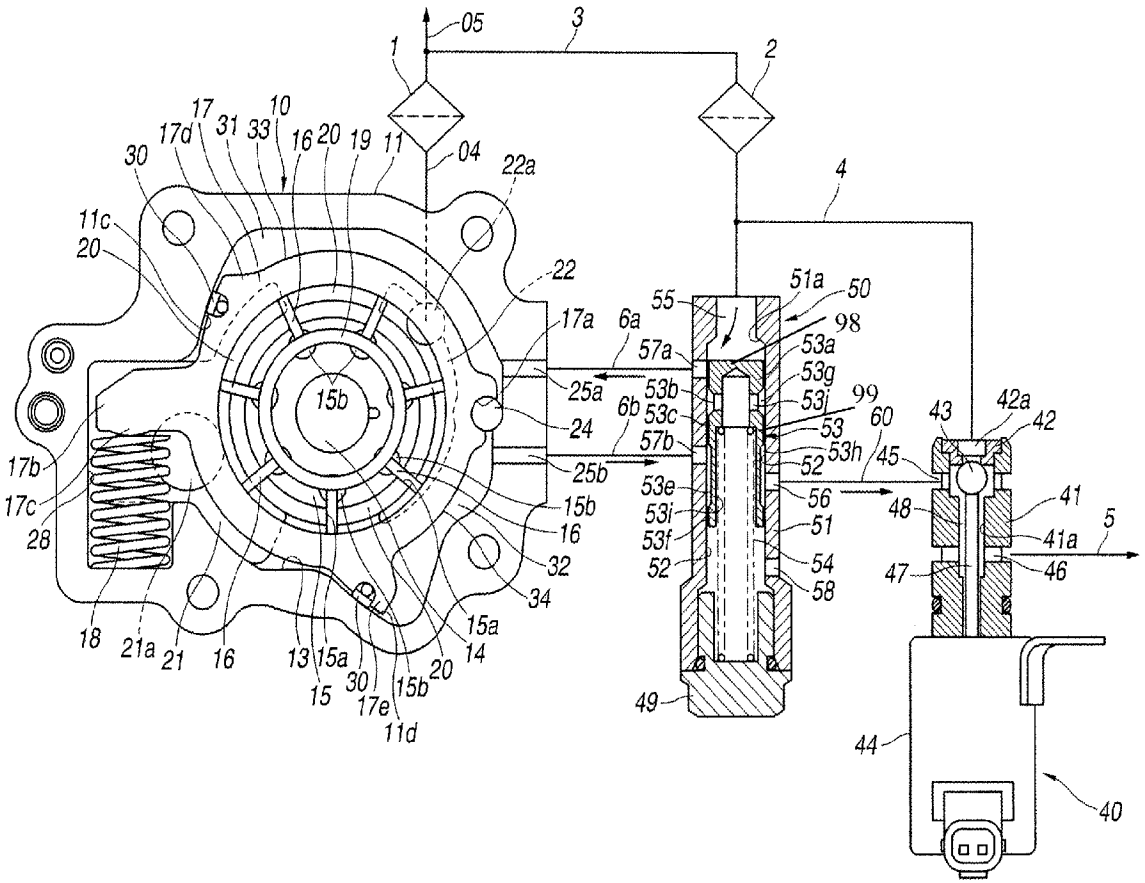
FIG. 7 is an operation illustrative view for illustrating an operation of the variable displacement oil pump of FIG. 2.
Figure 9:
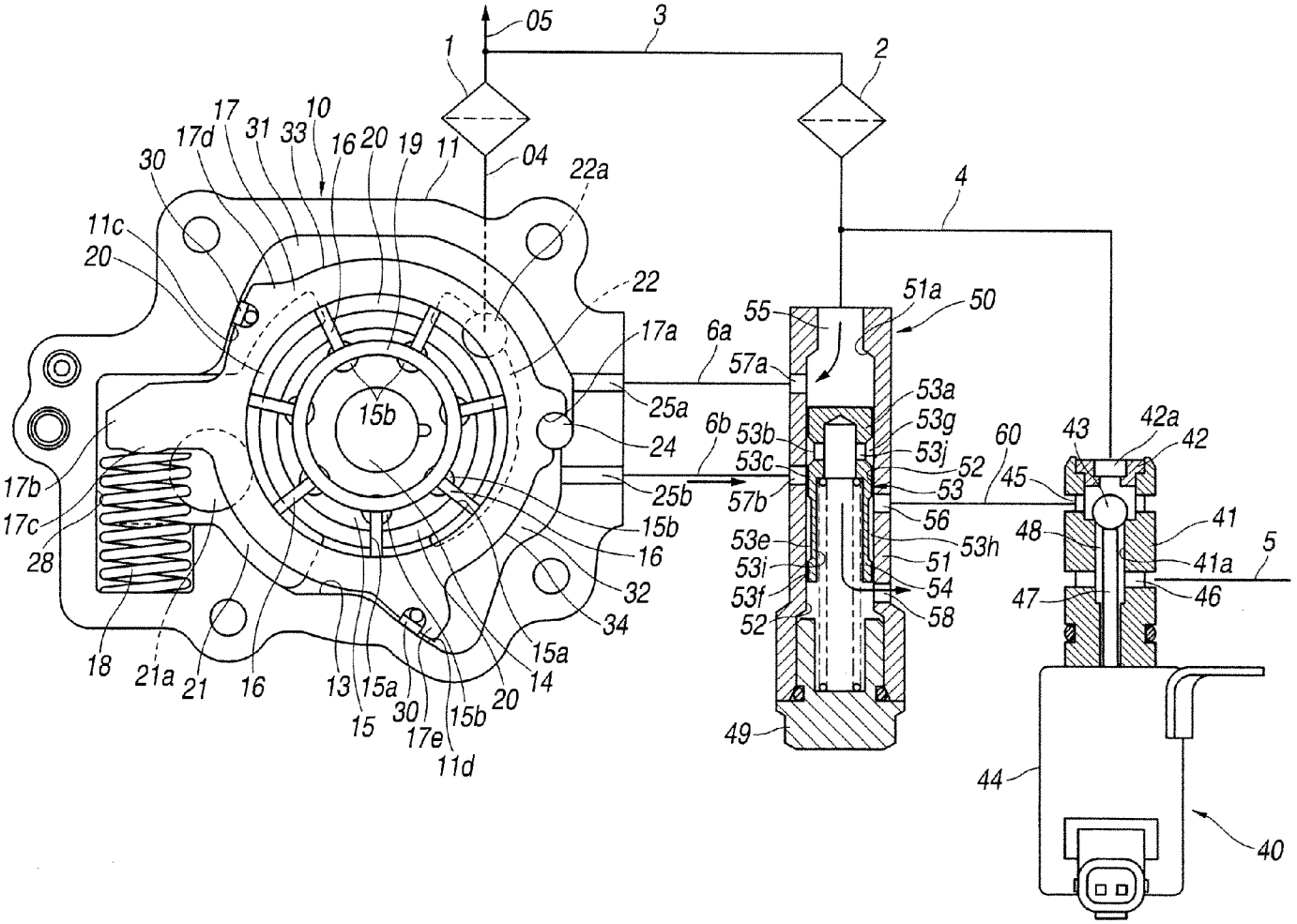
FIG. 9 is a view for illustrating an operation of the variable displacement oil pump of FIG. 2.

First control hydraulic chamber 31 receives the pump discharge pressure discharged to discharge port 22, from main oil gallery 05 and first branch passage 3, through pilot valve 50, and a first connection hole 25*a* formed in the side portion of pump body 11. A first pressure receiving surface 33 constituted by the outer circumference surface of cam ring 17 which confronts first control hydraulic chamber 31 receives the hydraulic pressure from main oil gallery 05 against the urging force of spring 18. With this, as shown in FIG. 7 and FIG. 9, the swing movement force (the movement force) in the direction in which the eccentric amount of cam ring 17 is decreased (in the counterclockwise direction in FIG. 2) is applied to cam ring 17.

That is, this first control hydraulic chamber 31 constantly urges cam ring 17 through first pressure receiving surface 33 in a concentric direction in which the center of cam ring 17 is moved closer to the center of the rotation of rotor 15, that is, in the direction in which the eccentric amount of cam ring 17 is decreased. With this, first control hydraulic chamber 17 serves for the control of the movement amount of cam ring 17 in the concentric direction.

On the other hand, second control hydraulic chamber 32 receives the discharge pressure of second branch passage 4, through pilot valve 50, and a second connection hole 25*b* which is formed in the side portion of pump body 11 in parallel with first connection hole 25*a*, and which penetrates through the side portion of pump body 11, in accordance with the ON and OFF actuation of electromagnetic switching valve 40.

Moreover, cam ring 17 includes a second pressure receiving surface 34 which is formed on the outer circumference surface of cam ring 17 that confronts second control hydraulic chamber 32. The discharge pressure is acted to this second pressure receiving surface 34, so as to become a force in a direction to assist the urging force of spring 18. With this, the swinging force in the direction (in the clockwise direction in FIG. 2) in which the eccentric amount of cam ring 17 is increased is applied to cam ring 17.

In this case, as shown in FIG. 2, second pressure receiving surface 34 has a pressure receiving area which is smaller than a pressure receiving area of first pressure receiving surface 33. The urging force of cam ring 17 in the eccentric direction which includes the urging force based on the internal pressure of second control hydraulic chamber 32, and the urging force of spring 18, and the urging force by first control hydraulic chamber 31 are balanced by a predetermined force relationship. As described above, the hydraulic pressure within second control hydraulic chamber 32 acts so as to assist the urging force of spring 18. That is, second control hydraulic chamber 32 acts the discharge pressure supplied through electromagnetic switching valve 40 and pilot valve 50, to second pressure receiving surface 34 so as to assist the urging force of spring 18, so as to control the movement amount of cam ring 17 in the eccentric direction.

Moreover, electromagnetic switching valve 40 is arranged to be actuated based on the excitation current from the control unit configured to control the internal combustion engine, in accordance with the driving state of the engine. This electromagnetic switching valve 40 connects second branch passage 4 and second connection hole 25*b*, or disconnect second branch passage 4 and second connection hole 25*b*.

As shown in FIG. 2 and FIG. 5, electromagnetic switching valve 40 is a three-way switching valve. Electromagnetic switching valve 40 includes a valve body 41 which is fixed by the press fit in a valve receiving hole 35*a* formed in a side wall of cylinder block 35 of the engine, and which includes an operation hole 41*a* formed inside valve body 41 to extend in the axial direction; a valve seat 42 which is press-fitted in a tip end portion of operation hole 41*a*, and which includes a solenoid opening port 42*a* which is formed at a substantially central portion of valve seat 42, and which is connected to a downstream side of second branch passage 4; a ball valve 43 which is made from a metal, which is arranged to be seated on and unstented from an inside of valve seat 42, and which is arranged to open and close solenoid opening port 42*a*; and a solenoid unit 44 which is provided at one end portion of valve body 41.

Valve body 41 includes a connection port 45 which is formed on an upper end portion of the circumferential wall, which penetrates through valve body 41 in the radial direction, and which is connected to second branch passage 4 through solenoid opening port 42*a*; and a drain port 46 which is formed on a lower end portion of the circumferential wall, which penetrates through valve body 41 in the radial direction, and which is connected to operation hole 41*a*.

Solenoid unit 44 includes an electromagnetic coil (not shown), a fixed iron core (not shown), a movable iron core (not shown) and so on which are disposed inside a casing. Solenoid unit 44 includes a push rod 47 which is provided at a tip end portion of the movable iron core, which is slidably moved within operation hole 41*a* with a predetermined gap, and which includes a tip end arranged to push ball valve 43 or release the pushing.

Between the outer circumference surface of push rod 47 and the inner circumference surface of operation hole 41*a*, there is formed a cylindrical passage 48 which connects connection port 45 and drain port 46.

The control unit of the engine applies and shuts off the current to (energizes and deenergizes) the electromagnetic coil, in the ON-OFF manner.

Figure 8:
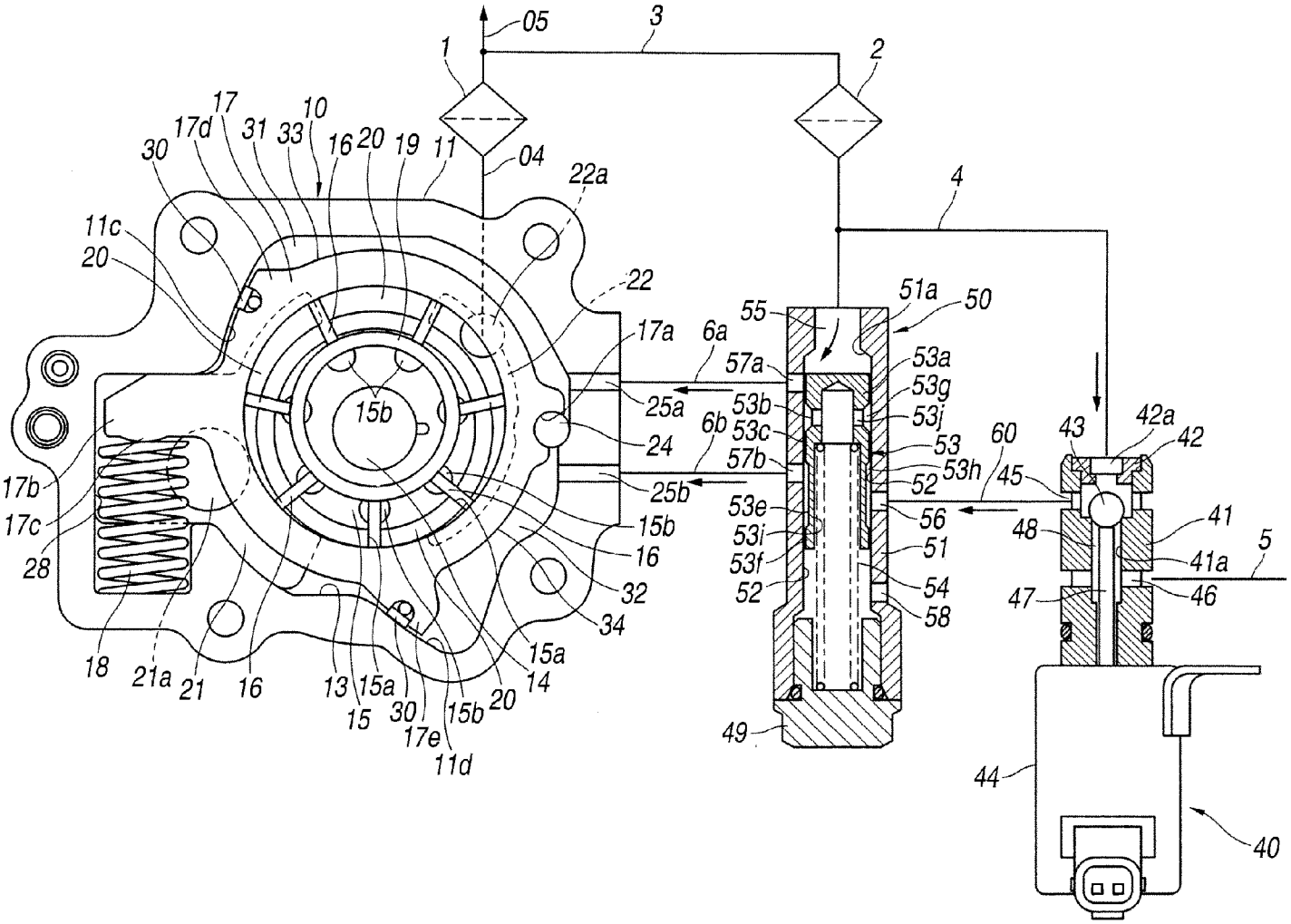
FIG. 8 is a view for illustrating an operation of the variable displacement oil pump of FIG. 2.

That is, when the control unit outputs the OFF signal (the deenergization) to the electromagnetic coil, the movable iron core is moved in a rearward direction (in a downward direction in FIG. 2) by the spring force of a return spring (not shown), so that push rod 47 releases the pushing of ball valve 43 to open solenoid opening port 42*a*. With this, as shown in FIG. 8 and FIG. 9, ball valve 43 is moved in the rearward direction by the discharge pressure from second branch passage 4 so as to connect second branch passage 4 and intermediate passage 60, so that the hydraulic pressure is supplied to second control hydraulic chamber 32. At the same time, the one end of cylindrical passage 48 is closed so as to disconnect cylindrical passage 48 (connection port 45) and drain port 46.

On the other hand, the control unit outputs the ON signal (energization) to the electromagnetic coil, the movable iron core is moved in a forward direction (in an upward direction) against the spring force of the return spring, so that push rod 47 pushes ball valve 43. With this, as shown in FIG. 2 and FIG. 7, ball valve 43 closes solenoid opening port 42*a*, and connection port 45 and cylindrical passage 48 are connected. Accordingly, the hydraulic pressure within second control hydraulic chamber 32 is discharged from pilot valve 50 and intermediate passage 60 through connection port 45, cylindrical passage 48, and drain port 46, to oil pan 01.

The control unit senses a current engine driving state from an oil temperature and a water temperature of the engine, the engine speed, the load and so on. The control unit is arranged to output the ON signal (the energization) to the electromagnetic coil of electromagnetic switching valve 40, in particular, when the engine speed is equal to or smaller than a predetermined speed, and to output the OFF signal (the deenergization) when the engine speed is higher than the predetermined speed.

However, when the engine is in a high load region even when the engine speed is equal to or smaller than the predetermined speed, the control unit outputs the OFF signal to the electromagnetic coil so as to supply the hydraulic pressure to second control hydraulic chamber 32.

Accordingly, oil pump 10 basically has two discharge pressure characteristics of a high pressure control state and a low pressure control state. In the low pressure control state, oil pump 10 controls the eccentric amount of cam ring 17 by the internal pressure of first control hydraulic chamber 31 to which the hydraulic pressure is supplied from main oil gallery 05, and the spring urging force of spring 18, so as to control the variation amounts of the volumes of pump chambers 20 at the drive of the pump. In the high pressure control state, oil pump 10 controls the eccentric amount of cam ring 17 by further adding the internal pressure of second control hydraulic chamber 32 by electromagnetic switching valve 40.

Moreover, the variable displacement oil pump according to the embodiment includes pilot valve 50. With this, it is possible to stabilize the low pressure control and the high pressure control of oil pump 10.

That is, as shown in FIG. 2, pilot valve 50 includes a valve body 51 which has a cylindrical shape; a sliding hole 52 which is formed in valve body 51; a spool valve 53 which is slidably received in sliding hole 52; and a valve spring 54 arranged to urge spool valve 53 in the upward direction of FIG. 2. Moreover, a plug 49 closes an opening end portion of a lower end portion of valve body 51 in a state in which valve spring 54 is provided with a spring load.

Valve body 51 includes a pilot pressure introduction port 55 which is formed at an upper end opening which is located above sliding hole 52, and which has a diameter smaller than a diameter of sliding hole 52. Moreover, valve body 51 includes a stepped taper surface 51*a* which is located between this pilot pressure introduction port 55 and sliding hole 52. This stepped taper surface 51*a* serves as a seat surface on which spool valve 53 is seated when spool valve 53 is urged in the upward direction by the spring force of valve spring 54 when the hydraulic pressure from pilot pressure introduction port 55 is not acted to spool valve 53.

Pilot pressure introduction hole 55 of valve body 51 is connected to first branch passage 3 bifurcated from main oil gallery 05 through second oil filter 2.

Valve body 51 includes a first supply and discharge port 57*a* which is formed in the circumferential wall confronting sliding hole 52, which penetrates in the radial direction, and which is a first control port connected through first supply and discharge passage 6*a* to first control hydraulic chamber 31; and a second supply and discharge port 57*b* which is formed in the circumferential wall confronting sliding hole 52, which penetrates in the radial direction, and which is a second control port connected through second supply and discharge passage 6*b* to second control hydraulic chamber 32. Moreover, valve body 51 includes a connection port 56 which is formed in the circumferential wall confronting sliding hole 52, which is formed on a lower side of second supply and discharge port 57*b* at a position opposite to second supply and discharge port 57*b*, which penetrates in the radial direction, and which is connected to one end of intermediate passage 60. Furthermore, valve body 51 includes a drain port 58 which is formed on the lower side of connection port 56, which penetrates in the radial direction, and which serves also as a back pressure escape port.

Spool valve 53 is formed into a substantially cylindrical shape having a closed upper end portion. Spool valve 53 includes a passage hole 53*i* which is formed inside spool valve 53, and in which a part of valve spring 54 is received. Spool valve 53 includes a first land portion 53*a* which is located on the uppermost side of the drawing that is the pilot pressure introduction port 55's side; a first small diameter shaft portion 53*b* which is formed on the lower side of first land portion 53*a*; a second land portion 53*c* which is formed on the lower side of first small diameter portion 53*b*; a second small diameter shaft portion 53*e* which is formed on the lower side of second land portion 53*c*, and which has an elongated shape extending in the axial direction; and a third land portion 53*f* which is formed on the lower side of second small diameter portion 53*e*.

First land portion 53*a*, second land portion 53*c*, and third land portion 53*f* have the same diameter. Outer circumference surfaces of first land portion 53*a*, second land portion 53*c*, and third land portion 53*f* are arranged to be slid on an inner circumference surface of sliding hole 52 with a minute clearance.

First land portion 53*a* has a cylindrical shape having a bottom portion. First land portion 53*a* includes an upper surface serving as a pressure receiving surface arranged to receive the discharge pressure introduced into pilot pressure introduction port 55. First land portion 53*a* is arranged to open and close first supply and discharge port 57*a* in accordance with the movement of spool valve 53 in the upward and downward directions.

Second land portion 53*c* is arranged to open and close second supply and discharge port 57*b* in accordance with the movement of spool valve 53 in the upward and downward directions.

Moreover, pilot valve 50 includes a first annular groove 53*g* which is located radially outside first small diameter shaft portion 53*b*, and which is formed into a tapered annular shape. On the other hand, pilot valve 50 includes a second annular groove 53*h* which is located radially outside second small diameter shaft portion 53*e*, and which is formed into a substantially cylindrical shape.

First annular groove 53*g* is connected from a through hole 53*j* penetrating through first small diameter shaft portion 53*b* in the radial direction, through passage hole 53*i* to sliding hole 52 and drain port 58. On the other hand, second annular groove 53*h* is arranged to connect second supply and discharge port 57*b* and connection port 56 in accordance with the sliding position of spool valve 53.

Besides, valve spring 54 is set to have a spring force smaller than a spring force of spring 18 of oil pump 10.

Intermediate passage 60 connects connection port 45 of electromagnetic switching valve 40 and connection port 56 of pilot valve 50.

First supply and discharge passage 6*a* connects first supply and discharge port 57*a* of pilot valve 50 and first connection hole 25*a* of oil pump 10. Second supply and discharge passage 6*b* connects second supply and discharge port 57*b* and second connection hole 25*b* of oil pump 10.

First branch passage 3, pilot pressure introduction port 55, first supply and discharge port 57*a*, first supply and discharge passage 6*a*, and so on constitute an introduction passage (section).

Intermediate passage 60, connection port 56, second supply and discharge passage 6*b*, second supply and discharge port 57*b*, and so on constitute a connection passage (section).

[Functions of Variable Displacement Oil Pump According to this Embodiment]

Hereinafter, functions of electromagnetic switching valve 40 and pilot valve 50 are illustrated with reference to a hydraulic pressure characteristic of FIG. 10.

Figure 10:
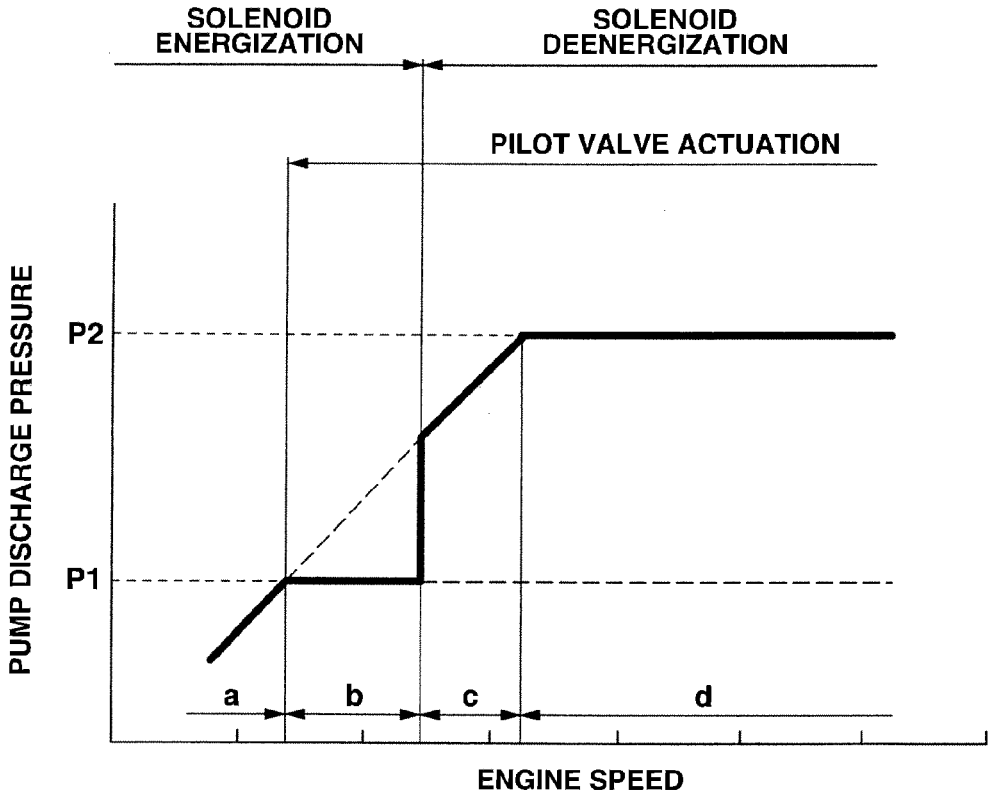
FIG. 10 is a graph showing a relationship between an engine speed and a pump discharge pressure in the variable displacement oil pump of FIG. 2.

FIG. 2 shows an operation state of variable displacement oil pump 10 in a region a which is shown in FIG. 10, and which is from a start of the engine to a low engine speed. In this state, the control unit outputs the ON signal to electromagnetic switching valve 40, so that electromagnetic switching valve 40 is in the energization state. Accordingly, connection port 45 and drain port 46 are connected with each other.

In pilot valve 50, first land portion 53*a* of spool valve 53 is seated on seat surface 51*a* for the low engine speed and the low hydraulic pressure. In this case, first control hydraulic chamber 31 is connected to drain port 58 through first supply and discharge passage 6*a*, first supply and discharge port 57*a*, first annular groove 53*g*, through hole 53*j*, and passage hole 53*i*. On the other hand, second control hydraulic chamber 32 is connected to drain passage 5 through second supply and discharge passage 6*b*, second supply and discharge port 57*b*, second annular groove 53*h*, connection port 56, and connection port 45 and drain port 46 of electromagnetic switching valve 40.

Accordingly, first control hydraulic chamber 31 and second control hydraulic chamber 32 are connected, respectively, to drain ports 58 and 46, so that the hydraulic pressure is not supplied to first control hydraulic chamber 31 and second control hydraulic chamber 32. Consequently, cam ring 17 is held to be pivoted in the clockwise direction of the drawing by the spring force of spring 18, that is, arm portion 17*b* of cam ring 17 is held to be abutted on stopper surface 28*a* so that the maximum eccentric amount of cam ring 17 is maintained. Consequently, the hydraulic pressure is proportionally increased as the pump rotational speed is increased.

Then, when the hydraulic pressure of main oil gallery 05 becomes equal to P1 shown in FIG. 10 by oil pump 10, the hydraulic pressure is acted to the upper surface of first land portion 53*a* of spool valve 53 from pilot pressure introduction port 55 of pilot valve 50, so that spool valve 53 is moved in the rearward direction (in the downward direction of the drawing) to a position shown in FIG. 7 against the spring force of valve spring 54.

In this way, when spool valve 53 is moved in the downward direction, pilot pressure introduction port 55 and first supply and discharge port 57*a* are connected with each other in a state where areas of the openings between pilot pressure introduction port 55 and first supply and discharge port 57*a* are throttled (decreased). Moreover, first supply and discharge port 57*a* and drain port 58 are disconnected from each other. Accordingly, the discharge pressure is introduced into first control hydraulic chamber 31. Consequently, cam ring 17 is started to be rotated in the counterclockwise direction against the spring force of spring 18, as shown in FIG. 7, so that the oil pump becomes the low pressure control state shown in the engine speed region b of FIG. 10.

Figure 6:
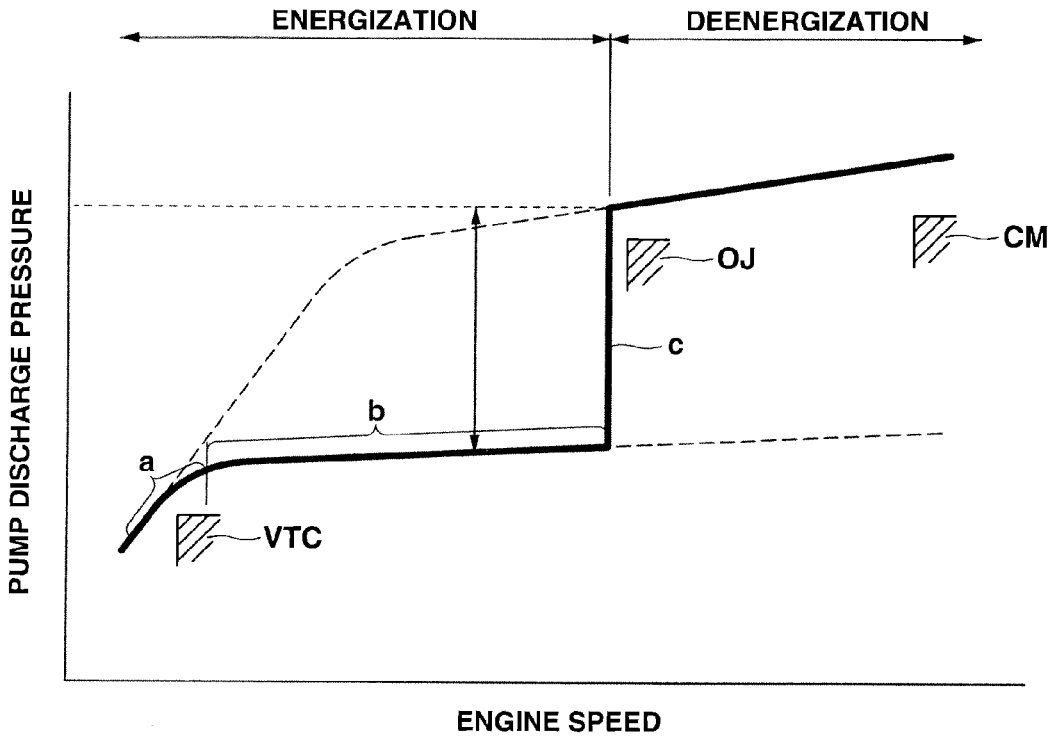
FIG. 6 is a graph showing a relationship between an engine speed and a pump discharge pressure in a conventional variable displacement oil pump which does not include a pilot valve.

In the conventional variable displacement oil pump which does not include pilot valve 50 of the variable displacement oil pump according to the embodiment of the present invention, even in the low pressure control state, the pump discharge pressure is increased in accordance with the increase of the engine speed at the hydraulic pressure control, as in the hydraulic pressure characteristic shown by a solid line of FIG. 6. In particular, the pump discharge pressure is further increased from a state in which the pump discharge pressure is increased in the vertical direction as shown by a symbol c in FIG. 6. Besides, a symbol a in FIG. 6 represents a region from the engine start to the low engine speed. A symbol b in FIG. 6 represents the low and middle engine speed region. The symbol c in FIG. 6 represents the high engine speed region. A symbol VTC represents a necessary hydraulic pressure of a valve timing control apparatus for the intake valves and the exhaust valves, according to the engine speed. A symbol OJ represents a necessary hydraulic pressure of an oil jet arranged to jet the coolant oil to the piston, according to the engine speed. A symbol CM represents a necessary hydraulic pressure of bearings for the crank shaft, according to the engine speed.

On the other hand, when pilot valve 50 is provided like the variable displacement oil pump according to the embodiment of the present invention, this pilot valve 50 controls the hydraulic pressure of first control hydraulic chamber 31. Accordingly, it is possible to suppress the excessive increase of the hydraulic pressure.

In pilot valve 50, when the discharge pressure is excessively decreased, spool valve 53 is moved by the spring force of valve spring 54 in the seat direction in which spool valve 53 is seated on stepped taper surface 51*a*. With this, as described above, first land portion 53*a* disconnects pilot pressure introduction port 55 and first supply and discharge port 57*a*, and connects first supply and discharge port 57*a* and drain port 58, so that the pressure of first control hydraulic chamber 31 is decreased. Accordingly, the eccentric amount of cam ring 17 is increased, so that the hydraulic pressure is increased.

When the discharge pressure is excessively increased in the above-described state, spool valve 53 is moved in the downward direction toward plug 49 against the spring force of valve spring 54. With this, pilot pressure introduction port 55 and first supply and discharge port 57*a* are connected with each other, so that the hydraulic pressure is supplied to first control hydraulic chamber 31. Accordingly, the eccentric amount of cam ring 17 is decreased, so that the discharge pressure is decreased.

These control operation can be performed by the slight movement of spool valve 53. Accordingly, the influence of the spring constant 54 is small. Therefore, it is possible to control the discharge pressure to a substantially pressure P1.

In particular, pilot pressure introduction port 55 and first supply and discharge port 57*a* are connected with each other in a state where the areas of the openings of pilot pressure introduction port 55 and first supply and discharge port 57*a* are small. Pilot pressure introduction port 55 and first supply and discharge port 57*a* are controlled in a state where the opening of first supply and discharge port 57*a* is throttled by the upper end edge of first land portion 53*a* of spool valve 53. Accordingly, it is possible to stably hold the discharge pressure to the substantially pressure P1.

Next, when the engine speed is further increased, the current to electromagnetic switching valve 40 is shut off (electromagnetic switching valve 40 is deenergized). With this, as shown in FIG. 8, in electromagnetic switching valve 40, solenoid opening port 42*a* and connection port 45 are connected with each other. In pilot valve 50, spool valve 53 is moved in the downward direction against the spring force of valve spring 54 in a state where pilot pressure introduction port 55 and first supply and discharge port 57*a* are held to be slightly connected with each other (the throttling state). A first throttling portion 98 is a passage portion connecting the discharge port 57*a* and an upper end edge of first land portion 53*a*, as indicated in FIG. 7. On the other hand, connection port 56 and second supply and discharge port 57*b* are held to be connected with each other through second annular groove 53*e*.

Accordingly, the discharge pressure of main oil gallery 05 is introduced into first control hydraulic chamber 31 and second control hydraulic chamber 32 through first branch passage 3 and second branch passage 4. Consequently, cam ring 17 is moved in the clockwise direction by the spring force of spring 18 and the hydraulic pressure of second control hydraulic chamber 32 which assists the spring force of spring 18. That is, cam ring 17 is moved in the direction in which the eccentric amount of cam ring 17 is increased. Therefore, the variable displacement oil pump 10 is shifted to the high pressure control shown in the symbol c in FIG. 10. In the engine speed region shown by the symbol c in FIG. 10, the discharge pressure does not reach the pressure P2 although the variable displacement oil pump is switched to the high pressure control. Accordingly, the eccentric amount of cam ring 17 becomes maximum again. The discharge pressure is increased in substantially proportional to the increase of the engine.

Then, when the discharge pressure becomes equal to pressure P2 by the increase of the engine speed, spool valve 53 of pilot valve 50 is further moved in the downward direction against the spring force of valve spring 54 by the hydraulic pressure acted to pilot pressure introduction port 55, as shown in FIG. 9. Accordingly, second land portion 53*c* disconnects connection port 56 and second supply and discharge port 57*b*. At the same time, second supply and discharge port 57*b* and first annular groove 53*g* (through hole 53*j*) are started to be connected with each other in a state where the areas of the openings between second supply and discharge port 57*b* and first annular groove 53*g* are small, so that second supply and discharge port 57*b* and first annular groove 53*g* are connected to drain port 58 through passage hole 53*i*. A second throttling portion 99 is a passage portion connecting the discharge port 57*b* and the first annular groove 53*g*, as indicated in FIG. 7. Accordingly, second supply and discharge port 57*b* and drain port 58 are started to be connected with each other.

With this, second control hydraulic chamber 32 is connected to drain port 58, so that second control hydraulic chamber 32 becomes the low pressure. Cam ring 17 receives the spring force of spring 18 only, as the force in the direction in which the eccentric amount is increased. Accordingly, the discharge pressure within first control hydraulic chamber 31 becomes greater than the spring force of spring 18, so that cam ring 17 is pivoted in the counterclockwise direction as shown in FIG. 9. That is, cam ring 17 is pivoted in a direction in which the eccentric amount of cam ring 17 becomes small. Consequently, the variable displacement oil pump becomes the flat and uniform high pressure control state which is shown by engine speed region d of FIG. 10.

In this way, it is possible to suppress the excessive increase of the hydraulic pressure at the high pressure control of the pump discharge pressure by the actuation of pilot valve 50.

That is, in the conventional variable displacement oil pump which does not include pilot valve 50, the hydraulic pressure is increased in accordance with the increase of the engine speed at the hydraulic pressure control, as shown by the above-described solid line of FIG. 6. This is because the discharge pressure is increased by the amount of the spring constant of spring 18 although it is necessary that the eccentric amount of cam ring 17 is further decreased when the engine speed is increased. On the other hand, the variable displacement oil pump according to the embodiments of the present invention includes pilot valve 50. Accordingly, when the pump discharge pressure is excessively decreased, spool valve 53 is moved in the upward direction (in the seat direction in which spool valve 53 is seated on seat surface 51*a*), so as to connect connection port 56 and second supply and discharge port 57*b*. Consequently, the hydraulic pressure is introduced into second control hydraulic chamber 32, so as to assist the spring force of spring 18. With this, cam ring 17 is moved in the direction in which the eccentric amount of cam ring 17 is increased, so that the discharge pressure is increased.

On the other hand, when the pump discharge pressure is excessively increased, spool valve 53 is moved in the downward direction against the spring force of valve spring 54, so as to connect drain port 58 and second supply and discharge port 57*b*. With this, the hydraulic pressure within second control hydraulic chamber 32 is decreased, so that the eccentric amount of cam ring 17 is controlled to be decreased so as to decrease the discharge pressure. These control operation can be performed by the slight movement of spool valve 53. Accordingly, the influence of the spring constant of valve spring 54 is small. Consequently, the hydraulic pressure can be controlled to the flat state of the discharge pressure of the substantially pressure P2, as shown in a region d in FIG. 10.

Moreover, in the variable displacement oil pump according to the embodiment of the present invention, in the b region state and the d region state of the engine speed which are shown in FIG. 10, first land portion 53*a* and second land portion 53*b* of spool valve 53 vary the area of the opening of first supply and discharge port 57*a* and the area of the opening of second supply and discharge port 57*b* in relatively opposite directions in which the sizes of the areas of the openings are varied, as shown in FIG. 8 and FIG. 9. That is, the introduction amount of the discharge pressure to first control hydraulic chamber 31 and the drain amount of the hydraulic pressure drained from second control hydraulic chamber 32 are relatively varied. Accordingly, it is possible to stabilize the flat discharge pressure control of the pressures P1 and P2.

Moreover, in the variable displacement oil pump according to the embodiment of the present invention, the timings of the switching of the ports (first supply and discharge port 57*a* and second supply and discharge port 57*b*) by first land portion 53*a* and second land portion 53*c* of spool valve 53 are simultaneous. However, first supply and discharge port 57*a* and second supply and discharge port 57*b* may be concurrently connected, and first supply and discharge port 57*a* and second supply and discharge port 57*b* may be concurrently disconnected.

Moreover, the boundaries (connection portions) between first and second land portions 53*a* and 53*c* of spool valve 53, and first small diameter portion 53*b* may be formed by chamfering, or may be curbed shape (R-shape). These are elements which vary the opening areas and the movement of spool valve 53 at the switching (of the ports). These are adjusted by in accordance with the pump capacity and the switching pressure.

Figure 11A:
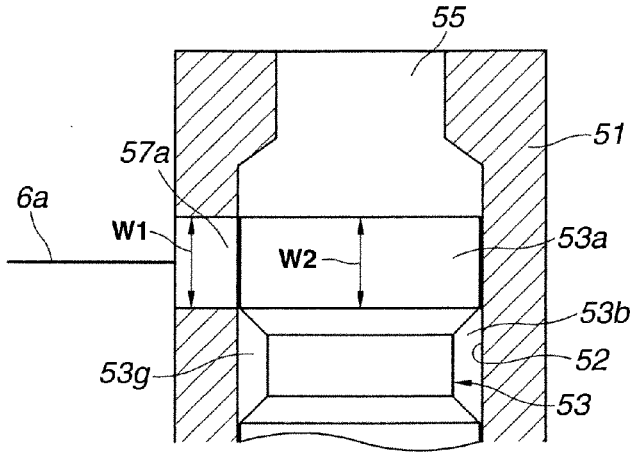
FIGS. 11A, 11B, and 11C are enlarged sectional views showing cases in which an opening area of a first supply and discharge port and a width of a first land portion of a spool valve are relatively varied.
Figure 11B:
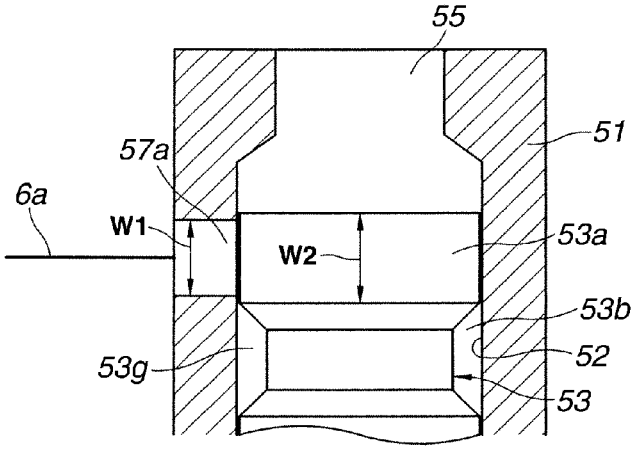
Figure 11C:
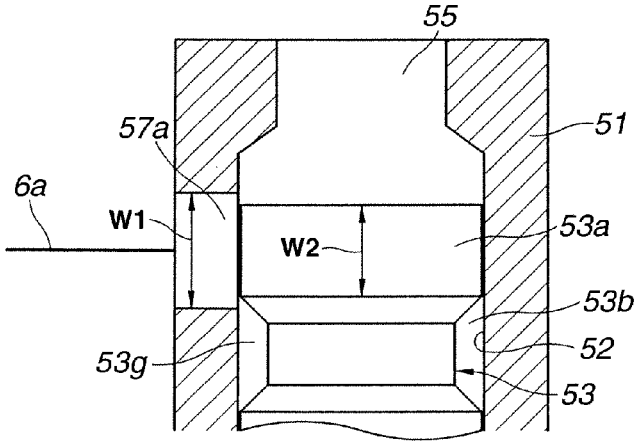

FIGS. 11A-11C show structures in which an opening width W1 of the one end opening of first supply and discharge port 57*a* connected to first supply and discharge passage 6*a*, and a width W2 of first land portion 53*a* are varied relative to those in the above-described example. In the variable displacement oil pump shown in FIG. 11A, the opening width W1 of first supply and discharge port 57*a* and width W2 of first land portion 53*a* are substantially identical to each other. In the variable displacement oil pump shown in FIG. 11B, width W2 of first land portion 53*a* is slightly larger than opening width W1 of first supply and discharge port 57*a*. In the variable displacement oil pump shown in FIG. 11C, opening width W1 of first supply and discharge port 57*a* is slightly larger than width W2 of first land portion 53*a*.

In this way, opening width W1 of first supply and discharge port 57*a* and width W2 of first land portion 53*c* are relatively varied. With this, it is possible to arbitrarily control the supply amount of the hydraulic pressure to first control hydraulic chamber 31 in accordance with the movement amount of spool valve 53.

Figure 12A:
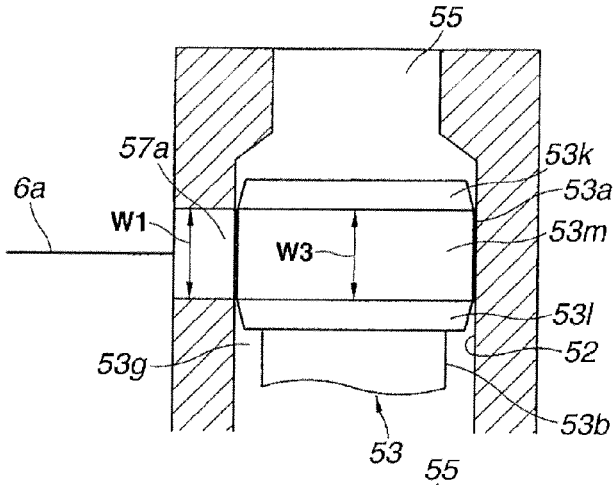
FIGS. 12A, 12B, and 12C are enlarged sectional views showing cases in which a shape of the first land portion of the spool valve is varied, and a width of a central portion of the first land portion and the opening area of the first supply and discharge port are relatively varied.
Figure 12B:
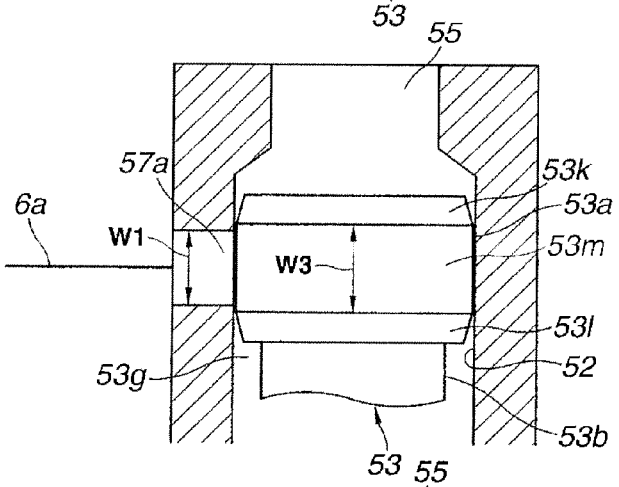
Figure 12C:
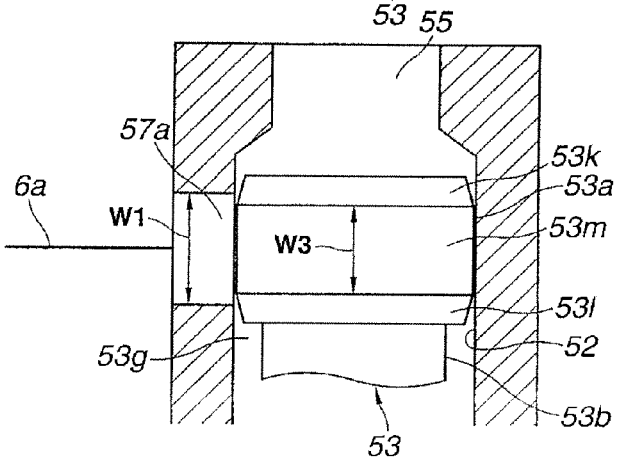

FIGS. 12A-12C show variable displacement oil pumps in which sizes of opening width W1 of the one end opening of first supply and discharge port 57*a* are varied like the variable displacement oil pumps shown in FIG. 11. On the other hand, first land portion 53*a* includes chamfering portions 53*k* and 531 which are formed at upper and lower portions of an outer circumference surface of first land portion 53*a*; and a central portion 53*m* which is located between these chamfering portions 53*k* and 531, and which has a width W3 which is identical to opening width W1 of the one end opening of first supply and discharge port 57*a*.

That is, in the variable displacement oil pump shown in FIG. 12A, opening width W1 of the one end opening of first supply and discharge port 57*a* is set substantially identical to width W3 of central portion 53*m* of first land portion 53*a*. In the variable displacement oil pump shown in FIG. 12B, opening width W1 of first supply and discharge port 57*a* is set smaller than width W3 of central portion 53*m* of first land portion 53*a*. In the variable displacement oil pump shown in FIG. 12C, opening width W1 of first supply and discharge port 57*a* is set larger than width W3 of central portion 53*m* of first land portion 53*a*. Even when width W3 of central portion 53*m* of first land portion 53*a* is larger than opening width W1 of the one end opening of first supply and discharge port 57*a*, there is minute clearances between central portion 53*m* and the one end opening of first supply and discharge port 57*a*. Accordingly, the three directions are not fully closed. These vary the relationship between the displacement of spool valve 53, and the variation of the opening areas of the connections. When the opening area of the pilot pressure introduction port 55 is varied, the opening area of the first annular groove 53*g* is reversely varied. These are appropriately selected and used in accordance with the specification of the pump main body, and the magnitude of the hydraulic pressure.

When the diameter of the hole of first supply and discharge port 57*a* and the width of first land portion 53*a* are identical to each other, or when the width of first land portion 53*a* is larger than the diameter of the hole of first supply and discharge port 57*a*, the lengths of the minute clearances of sliding holes 52 are identically varied.

Moreover, the above-described variation is applicable to a relationship between second land portion 53*c* and second supply and discharge port 57*b*.

The control unit judges the timing of the switching of the energization of electromagnetic switching valve 40 in accordance with the driving state of the engine. The timing of the switching of the energization of electromagnetic switching valve 40 is not limited to the state shown in FIG. 10. Moreover, the timing may be shifted from the state of the engine speed region a to the state of the engine speed region c, and may be shifted from the state of the engine speed region b to the state of the engine speed region d.

In general, the necessary hydraulic pressure (the desired hydraulic pressure) of the injection pressure of the oil jet and the necessary hydraulic pressure (the desired hydraulic pressure) of the bearings of the crank are desired at the high engine speed. Accordingly, electromagnetic switching valve 40 is energized at the low engine speed so that the oil pump is brought to the low pressure control. With this, the increase of the hydraulic pressure is prevented so as to decrease the power consumption. Moreover, electromagnetic switching valve 40 is deenergized at the high engine speed so that the oil pump is brought to the high pressure control. With this, the discharge pressure is increased to the necessary level, and the characteristic shown by the solid line of FIG. 6 is obtained.

Moreover, it is possible to vary the engine speed at which the energization of electromagnetic switching valve 40 is switched, in accordance with the driving state of the internal combustion engine. The control unit judges the engine speed at which the energization of electromagnetic switching valve 40 is switched by parameters such as the load, the engine speed, the oil temperature, and the water temperature, as described above.

For example, the control operation is switched the high pressure control from the low engine speed, at the high load and the high oil temperature. With this, it is possible to prevent the knocking by the injection of the oil jet. Accordingly, it is possible to improve the fuel consumption by advancing the firing (ignition) timing. Moreover, at the low oil temperature, the control operation is held to the low pressure control so as to decrease the power consumption. Moreover, the injection from the oil jet is stopped so that the warming time is shortened so as to decrease the discharge of the HC (hydrocarbon).

By the way, in the high pressure control state at the high engine speed, the pulsation of main oil gallery 05 becomes large. When the pulsation is acted to first and second control hydraulic chambers 31 and 32, cam ring 17 is vibrated so that the pulsation of the discharge of the pump is amplified (increased), so that the noise and the vibration are generated.

In a state where the high hydraulic pressure is supplied to both of first control hydraulic chamber 31 and second control hydraulic chamber 32, the pulsation is similarly acted to first control hydraulic chamber 31 and second control hydraulic chamber 32. Accordingly, cam ring 17 is vibrated by the pulsation having the superimposed phase, so that cam ring 17 becomes unstable.

However, in the variable displacement oil pump according to the embodiment of the present invention, second oil filter 2 is provided on the downstream portion of first branch passage 3 bifurcated from main oil gallery 05, and at a position upstream of the branch portion between first branch passage 3 and second branch passage 4. Accordingly, it is possible to attenuate (decrease) the pulsation before the branch portion by the resistance of second coil filter 2.

Consequently, it is possible to equally decrease the pulsation of first control hydraulic chamber 31 and the pulsation of second control hydraulic chamber 32. Accordingly, it is not generated that the balance is disturbed by increasing the pulsation of one of control hydraulic chambers 31 and 32. Therefore, it is possible to stabilize the movement of cam ring 17.

Moreover, in the abnormal state such as the malfunction (failure) of electromagnetic switching valve 40, the fail-safe needs to be constituted so that the pump discharge pressure becomes the high pressure control at the high engine speed, at the high load, and at the high oil temperature. That is, the electromagnetic coil is arranged to connect solenoid opening port 42*a* and connection port 45 in the deenergization state so that the hydraulic pressure is introduced to second control hydraulic chamber 32 at the malfunction such as the breaking (disconnection) of the harness and the coil of electromagnetic switching valve 40.

Second oil filter 2 is provided on the upstream side of electromagnetic switching valve 40. Accordingly, it is possible to prevent the malfunction of electromagnetic switching valve 40 by the clogging of the contamination. Moreover, it is possible to prevent the connection between second control hydraulic chamber 32 and drain passage 5 at the deenergization.

First oil filter 1 is provided between oil pump 10 and main oil gallery 05. Accordingly, in general, the contamination does not flow into main oil gallery 05 and first branch passage 3.

However, for example, when first oil filter 1 is clogged, bypass valve 09 is opened for protecting the engine. Accordingly, the contamination may flow to the first branch passage 3's side at this time.

However, the above-described case is not so generated in the set exchanging time period of first oil filter 1. Accordingly, second oil filter 2 can be non-exchangeable filter smaller than first oil filter 1.

Moreover, in the above-described case, second oil filter 2 is only necessary to collect the contamination which has a size by which the contamination is caught in ball valve 43 within electromagnetic switching valve 40 so as to lock ball valve 43. Accordingly, second oil filter 2 can have a mesh size larger than that of first oil filter 1.

When second oil filter 2 is also clogged when the oil pump is driven for the long time period in a state where first oil filter 1 is bypassed, the passage is shut off at a position before the branch between first branch passage 3 and second branch passage 4. Accordingly, the hydraulic pressure is not introduced into first control hydraulic chamber 31 and second control hydraulic chamber 32.

In this case, cam ring 17 becomes the maximum eccentric amount by the spring load of spring 18. The oil pump is held to the maximum capacity state, so that it is possible to maintain the high hydraulic pressure.

The high hydraulic pressure is maintained, irrespective of the energization and the deenergization of electromagnetic switching valve 40. Accordingly, it is possible to maintain the high hydraulic pressure even when the failure of electromagnetic switching valve 40 is also generated.

Moreover, the check valve of bypass valve 09 is actuated with respect to the excessive hydraulic pressure. With this, it is possible to suppress the breakage of the components of oil pump 10 and the hydraulic circuit.

Moreover, when the high hydraulic pressure state is continued, the oil may leak and flow into first control hydraulic chamber 31 and second control hydraulic chamber 32 since first control hydraulic chamber 31 and second control hydraulic chamber 32 are adjacent to discharge port 34 to sandwich gaps between ring members 19 and 19, and side surfaces of pump body 1 and cover member 12.

The oil flows from seal members 30 and 30 into the suction side which is the low pressure portion since second oil filter 2 is clogged. However, the hydraulic pressures of first control hydraulic chamber 31 and second control hydraulic chamber 32 are increased since the inflowing amount is larger than the outflowing amount.

In the deenergization state of electromagnetic switching valve 40, first control hydraulic chamber 31 and second control hydraulic chamber 32 are connected through electromagnetic switching valve 40 and pilot valve 50 to first and second branch passages 3 and 4. Accordingly, first control hydraulic chamber 31 and second control hydraulic chamber 32 become the same hydraulic pressure. When the pressure is increased to the above-described predetermined hydraulic pressure in the same hydraulic pressure state of first control hydraulic chamber 31 and second control hydraulic chamber 32, cam ring 17 is started to be moved in the clockwise direction, so that it is possible to control the discharge pressure on the high pressure side.

Moreover, when first oil filter 1 is clogged, the hydraulic pressure of main oil gallery 05 becomes low (is decreased), so that the hydraulic pressures of first and second control hydraulic chambers 31 and 32 become greater than the hydraulic pressure of main oil gallery 05. Accordingly, the oil flows from first and second control hydraulic chambers 31 and 32 to main oil gallery 05. With this, the contamination of the clogged second oil filter 2 (the contamination with which second oil filter 2 is clogged) is once removed from second oil filter 2.

[Failure Diagnosis]

In the variable displacement oil pump according to the embodiment of the present invention, it is possible to perform a failure diagnosis by a hydraulic pressure sensor or a hydraulic pressure switch provided in main oil gallery 05. In the energization state of electromagnetic switching valve 40, it is previously set that the pressure becomes equal to or smaller than a predetermined hydraulic pressure at a predetermined engine speed and at a predetermined oil temperature. Moreover, in the deenergization state of electromagnetic switching valve 40, it is previously set that the pressure becomes equal to or greater than a predetermined hydraulic pressure at a predetermined engine speed and at a predetermined oil temperature.

It is judged that the failure is generated when the hydraulic pressure is different from the hydraulic pressure previously set with respect to the command to electromagnetic switching valve 40. Moreover, warning and so on is lightened, and electromagnetic switching valve 40 is brought to the deenergization state, so that the oil pump is brought to the high pressure control state.

[a] A variable displacement oil pump according to the embodiment of the present invention includes: a rotor rotationally driven; a plurality of vanes provided in an outer circumference portion of the rotor to be projectable from and retractable into the rotor; a cam ring which receives the rotor and the vanes therein to form a plurality of pump chambers, and which is moved so as to vary an eccentric amount of a center of an inner circumference surface of the cam ring with respect to a center of a rotation of the rotor; a suction portion opened in the pump chambers whose volumes are increased when the cam ring is eccentrically moved in a first direction with respect to the center of the rotation of the rotor; a discharge portion opened in the pump chambers whose volumes are decreased when the cam ring is eccentrically moved in a second direction with respect to the center of the rotation of the rotor; an urging member arranged to urge the cam ring in the first direction in which the eccentric amount of the cam ring is increased with respect to the center of the rotation of the rotor; a first control hydraulic chamber which is arranged to receive a discharge pressure from the discharge portion through an introduction passage, and thereby to apply, to the cam ring, a force to eccentrically move the cam ring in the second direction in which the eccentric amount of the cam ring is decreased against an urging force of the urging member; a second control hydraulic chamber which is arranged to receive the hydraulic fluid, and thereby to apply, to the cam ring, to a force to move the cam ring in the first direction by cooperating with the urging force of the urging member; a switching mechanism arranged to switch a state in which the hydraulic fluid is introduced to the second control hydraulic chamber through a connection passage connecting the discharge portion and the second control hydraulic chamber, and a state in which the hydraulic fluid is discharged from the second control hydraulic chamber through the connection passage; and a control mechanism arranged to supply the discharge pressure to the first control hydraulic chamber or shut off the supply of the discharge pressure to the first control hydraulic chamber, in accordance with the discharge pressure of the discharge portion, and to supply a hydraulic pressure through the connection passage to the second control hydraulic chamber or discharge the hydraulic pressure through the connection passage from the second control hydraulic chamber, in accordance with the discharge pressure of the discharge portion, the control mechanism being arranged to supply the discharge pressure to the first control hydraulic chamber and to discharge the hydraulic fluid within the second control hydraulic chamber when the discharge pressure of the discharge portion is greater than a desired discharge pressure.

[b] In the variable displacement oil pump according to the embodiments of the present invention, the switching mechanism is an electromagnetic switching valve arranged to be electrically controlled be switched.

[c] In the variable displacement oil pump according to the embodiments of the present invention, the control mechanism is arranged to vary the opening area of the first control port to be decreased and to vary the opening area of the flow passage from the second control port to the drain port to be increased, when the spool valve is moved in the other direction against the spring force of the control spring in the second state.

[d] In the variable displacement oil pump according to the embodiments of the present invention, the control mechanism is arranged to vary the opening area of the first control port to be decreased, to open the flow passage from the second control port to the drain port, and then to vary the opening area of the flow passage from the second control port to the drain port to be increased, when the spool valve is moved in the other direction against the spring force of the control spring in the second state.

[e] In the variable displacement oil pump according to the embodiments of the present invention, the control mechanism is arranged to vary the opening area of the first control port to be decreased and to close the first control port when the spool valve is moved in the other direction against the spring force of the control spring in the second state, and then to open the flow passage from the second control port to the drain port, and then to vary the opening area of the flow passage from the second control port to the drain port to be increased.

[f] In the variable displacement oil pump according to the embodiments of the present invention, the spool valve includes a hollow passage hole including a first axial end portion opened, and a second axial end portion including a through hole penetrating in the radial direction; the control spring is disposed on the first axial end portion side of the passage hole of the spool valve; the through hole of the second axial end portion of the spool valve is connected to the passage hole of the spool valve; and the through hole and the passage hole constitute the flow passage between the second control port and the drain port.

[g] In the variable displacement oil pump according to the embodiments of the present invention, the oil discharged from the discharge portion is an oil for lubricating an internal combustion engine.

[h] In the variable displacement oil pump according to the embodiments of the present invention, the oil discharged from the discharge portion is an oil for driving a variable valve actuating apparatus of the internal combustion engine, and for cooling a piston, and which is injected by an oil jet.

The entire contents of Japanese Patent Application No. 2012-258827 filed Nov. 27, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement oil pump comprising:

a rotor rotationally driven;

a plurality of vanes provided in an outer circumference portion of the rotor to be projectable from and retractable into the rotor;

a cam ring which receives the rotor and the vanes therein to form a plurality of pump chambers, and which is moved so as to vary an eccentric amount of a center of an inner circumference surface of the cam ring with respect to a center of a rotation of the rotor;

a suction portion opened in pump chambers of the plurality of pump chambers whose volumes are increased in accordance with the rotation of the rotor;

a discharge portion opened in pump chambers of the plurality of pump chambers whose volumes are decreased in accordance with the rotation of the rotor;

an urging member arranged to urge the cam ring in a direction in which the eccentric amount of the cam ring is increased with respect to the center of the rotation of the rotor;

a first control hydraulic chamber which is arranged to receive a hydraulic fluid discharged from the discharge portion, and thereby to apply, to the cam ring, a force to eccentrically move the cam ring in a direction in which the eccentric amount of the cam ring is decreased against an urging force of the urging member;

a second control hydraulic chamber which is arranged to receive the hydraulic fluid, and thereby to apply, to the cam ring, a force to eccentrically move the cam ring in a direction in which the eccentric amount of the cam ring is increased by cooperating with the urging force of the urging member;

a switching mechanism to which the hydraulic fluid discharged from the discharge portion is introduced, and which is arranged to switch a state in which the introduced hydraulic fluid is introduced to a connection passage connected to the second control hydraulic chamber, and a state in which the hydraulic fluid is discharged from the second control hydraulic chamber through the connection passage; and a control mechanism to which the hydraulic fluid discharged from the discharge portion is introduced, which is arranged to be actuated before the eccentric amount of the cam ring becomes minimum, and which is arranged to disconnect the discharge portion and the first control hydraulic chamber when a discharge pressure of the hydraulic fluid discharged from the discharge portion is smaller than a first discharge pressure, to introduce the introduced hydraulic fluid to an introduction passage connected to the first control hydraulic chamber when the discharge pressure is greater than the first hydraulic pressure, to connect the switching mechanism and the second control hydraulic chamber when the discharge pressure is smaller than a second hydraulic pressure which is greater than the first discharge pressure, and to connect the connection passage to a discharge passage arranged to discharge the hydraulic fluid within the second control hydraulic chamber when the discharge pressure is greater than the second discharge pressure.

2. The variable displacement oil pump as claimed in claim 1, wherein the switching mechanism is an electromagnetic switching valve arranged to be electrically controlled to be switched.

3. A variable displacement oil pump comprising:

a rotor rotationally driven;

a plurality of vanes provided in an outer circumference portion of the rotor to be projectable from and retractable into the rotor;

a cam ring which receives the rotor and the vanes therein to form a plurality of pump chambers, and which is moved so as to vary an eccentric amount of a center of an inner circumference surface of the cam ring with respect to a center of a rotation of the rotor;

a suction portion opened in pump chambers of the plurality of pump chambers whose volumes are increased in accordance with the rotation of the rotor;

a discharge portion opened in pump chambers of the plurality of pump chambers whose volumes are decreased in accordance with the rotation of the rotor;

an urging member arranged to urge the cam ring in a direction in which the eccentric amount of the cam ring is increased with respect to the center of the rotation of the rotor;

a first control hydraulic chamber which is arranged to receive a hydraulic fluid, and thereby to apply, to the cam ring, a force to eccentrically move the cam ring in the second direction in which the eccentric amount of the cam ring is decreased against an urging force of the urging member;

a second control hydraulic chamber which is arranged to receive the hydraulic fluid, and thereby to apply, to the cam ring, a force to eccentrically move the cam ring in a direction in which the eccentric amount of the cam ring is increased by cooperating with the urging force of the urging member;

a switching mechanism which includes an opening port to which the hydraulic fluid discharged from the discharge portion is introduced, a discharge port arranged to discharge the hydraulic fluid, and a connection port selectively connected to the opening port and the discharge portion, and which is arranged to switch a state in which the hydraulic fluid introduced from the opening port is introduced to the connection port, and a state in which the connection passage and the discharge port are connected to each other; and a control mechanism including;

a valve body including an introduction port to which the hydraulic fluid discharged from the discharge port is introduced, a first control port connected to the first control hydraulic chamber, a second control port connected to the second control hydraulic chamber through a connection passage, a connection port connected to the connection port of the switching mechanism, and a drain port, a spool valve slidably received within the valve body, and arranged to control connection states of the introduction port, the first control port, the second control port, the connection port, and the drain port, and a control spring arranged to urge the spool valve in one direction by the urging force, the control mechanism being arranged to be brought to a first state in which the spool valve closes the introduction port, the first control port and the drain port are connected with each other, and the second control port and the connection port of the control mechanism are connected with each other, at an initial position at which the spool valve is maximally moved in the one direction by being urged by the control spring, and to be brought to a second state in which the introduction port and the first control port are connected with each other, and the second control port and the connection port of the control mechanism are connected with each other when the hydraulic pressure within the introduction port becomes high by the increase of the discharge pressure and the spool valve is moved in the other direction against the urging force of the control spring, and the control mechanism being arranged to be brought to a third state in which the second control port and the drain port are connected to each other, when the spool valve is further moved in the other direction against a spring force of the control spring.

4. The variable displacement oil pump as claimed in claim 3, wherein the control mechanism is arranged to vary an opening area of the first control port to be decreased and to vary an opening area of a flow passage from the second control port to the drain port to be increased, when the spool valve is moved in the other direction against the spring force of the control spring in the second state.

5. The variable displacement oil pump as claimed in claim 4, wherein the control mechanism is arranged to vary the opening area of the first control port to be decreased, to open the flow passage from the second control port to the drain port, and then to vary the opening area of the flow passage from the second control port to the drain port to be increased, when the spool valve is moved in the other direction against the spring force of the control spring in the second state.

6. The variable displacement oil pump as claimed in claim 5, wherein the control mechanism is arranged to vary the opening area of the first control port to be decreased and to close the first control port when the spool valve is moved in the other direction against the spring force of the control spring in the second state, and then to open the flow passage from the second control port to the drain port, and then to vary the opening area of the flow passage from the second control port to the drain port to be increased.

7. The variable displacement oil pump as claimed in claim 6, wherein the oil discharged from the discharge portion is an oil for lubricating an internal combustion engine.

8. The variable displacement oil pump as claimed in claim 7, wherein the oil discharged from the discharge portion is an oil for driving a variable valve actuating apparatus of the internal combustion engine, and for cooling a piston, and which is injected by an oil jet.

9. The variable displacement oil pump as claimed in claim 3, wherein the spool valve includes a hollow passage hole including a first axial end portion which is opened, and a second axial end portion including a through hole penetrating in the radial direction; the control spring is disposed on the first axial end portion side of the passage hole of the spool valve; the through hole of the second axial end portion of the spool valve is connected to the passage hole of the spool valve; and the through hole and the passage hole constitute a flow passage between the second control port and the drain port.

10. A variable displacement oil pump comprising:

a pump constituting section arranged to vary volumes of a plurality of hydraulic fluid chambers by being rotationally driven, and thereby to discharge an oil sucked from a suction portion, from a discharge portion;

a variable mechanism arranged to vary a variation amount of the volumes of the hydraulic fluid chambers opened to the discharge portion, by a movement of a movable member;

an urging member arranged to urge the movable member in a state to apply, to the movable member, a spring force in a direction in which variation amounts of volumes of the hydraulic fluid chambers opened to the discharge portion are increased;

a first control hydraulic chamber which is arranged to receive the discharge pressure from the discharge portion, and thereby to apply, to the movable mechanism, a force in a direction opposite to the direction of the urging force of the urging member;

a second control hydraulic chamber which is arranged to receive the hydraulic fluid, and thereby to apply, to the movable mechanism, a force in a direction identical to the direction of the urging force of the urging member;

a switching mechanism arranged to switch a state in which the hydraulic fluid discharged from the discharge portion is introduced to the second control hydraulic chamber, and a state in which the hydraulic fluid within second control hydraulic chamber is discharged; and a control mechanism which includes a first throttling portion that is opened to a passage connected to the first control hydraulic chamber, and that is arranged to increase a throttling area as the discharge pressure of the hydraulic fluid discharged from the discharge portion becomes larger than a first discharge pressure, a first passage constituting a part of a connection passage connecting the second control hydraulic chamber and the switching mechanism when the discharge pressure is smaller than a second discharge pressure which is smaller than the first discharge pressure, and a second throttling portion which is arranged to increase a throttling area as the discharge pressure of the hydraulic fluid discharged from the discharge portion becomes larger than a second discharge pressure which is larger than the first discharge pressure with respect to a second passage connecting the second control hydraulic chamber and a low pressure portion, wherein the control mechanism is arranged to supply the hydraulic fluid to the first control hydraulic chamber through the first throttling portion when the discharge pressure becomes the first discharge pressure, discharge the hydraulic fluid within the second control hydraulic chamber through the first passage and the switching mechanism, or introduce the hydraulic fluid supplied from the switching mechanism through the first passage to the second control hydraulic chamber, in accordance with a control state of the switching mechanism, and discharge the hydraulic fluid to the low pressure portion from the second control hydraulic chamber through the second throttling portion when the discharge pressure becomes the second discharge pressure.

11. A variable displacement oil pump comprising:

a rotor rotationally driven;

a plurality of vanes provided in an outer circumference portion of the rotor to be projectable from and retractable into the rotor;

a cam ring which receives the rotor and the vanes therein to form a plurality of pump chambers, and which is moved so as to vary an eccentric amount of a center of an inner circumference surface of the cam ring with respect to a center of a rotation of the rotor;

a suction portion opened in the pump chambers whose volumes are increased in accordance with the rotation of the rotor;

a discharge portion opened in the pump chambers whose volumes are decreased in accordance with the rotation of the rotor;

an urging member arranged to urge the cam ring in a direction in which the eccentric amount of the cam ring is increased with respect to the center of the rotation of the rotor;

a first control hydraulic chamber which is arranged to receive a hydraulic fluid discharged from the discharge portion, and thereby to apply, to the cam ring, a force to eccentrically move the cam ring in a direction in which the eccentric amount of the cam ring is decreased against an urging force of the urging member;

a second control hydraulic chamber which is arranged to receive the hydraulic fluid, and thereby to apply, to the cam ring, a force to eccentrically move the cam ring in a direction in which the eccentric amount of the cam ring is increased by cooperating with the urging force of the urging member;

a switching mechanism to which the hydraulic fluid discharged from the discharge portion is introduced, and which is arranged to switch a state in which the introduced hydraulic fluid is introduced to the second control hydraulic chamber through a connection passage, and a state in which the hydraulic fluid is discharged from the second control hydraulic chamber through the connection passage; and a control mechanism arranged to supply the hydraulic fluid discharged from the discharge portion to the first control hydraulic chamber or shut off the supply of the hydraulic fluid discharged from the discharge portion to the first control hydraulic chamber, in accordance with the discharge pressure of the hydraulic fluid discharged from the discharge portion, and to supply the hydraulic fluid discharged from the discharge portion through the connection passage to the second control hydraulic chamber or discharge the hydraulic fluid discharged from the discharge portion through the connection passage from the second control hydraulic chamber, in accordance with the discharge pressure of the discharge portion, wherein the control mechanism is arranged to shut off the supply of the hydraulic fluid discharged from the discharge portion to the first control hydraulic chamber, and to discharge the hydraulic fluid within the second control hydraulic chamber through the connection passage from the switching mechanism, when the discharge pressure is smaller than a first discharge pressure, supply the hydraulic fluid discharged from the discharge portion to the first control hydraulic chamber, and to discharge the hydraulic fluid within the second control hydraulic chamber through the connection passage from the switching mechanism, when the discharge pressure is larger than the first discharge pressure, the control mechanism being arranged to supply the hydraulic fluid discharged from the discharge portion to the first control hydraulic chamber and the second control hydraulic chamber when the discharge pressure is larger than the first hydraulic pressure, and smaller than the second discharge pressure, and supply the hydraulic fluid discharged from the discharge portion to the first control hydraulic chamber, and to discharge the hydraulic fluid within the second control hydraulic chamber from a discharge passage provided within the control mechanism.

* * * * *